US006995122B2

(12) United States Patent
Popplewell et al.

(10) Patent No.: US 6,995,122 B2
(45) Date of Patent: Feb. 7, 2006

(54) METHOD FOR IMPARTING SUBSTANTIVE FRAGRANCE AND, OPTIONALLY, ANTI-STATIC PROPERTIES TO FABRICS DURING WASHING AND/OR DRYING PROCEDURE AND COMPOSITIONS USEFUL FOR EFFECTING SUCH PROCESSES

(75) Inventors: Lewis Michael Popplewell, Morganville, NJ (US); Gerry A. Helft-Brummer, Ocean, NJ (US); Robert V. Russo, Brooklyn, NY (US); Franklin A. Pringgosusanto, Laurence Harbor, NJ (US); Christopher L. Gellner, Brick, NJ (US)

(73) Assignee: International Flavors & Fragrances Inc., New York, NY (US)

( * ) Notice: Subject to any disclaimer, the term of this patent is extended or adjusted under 35 U.S.C. 154(b) by 272 days.

(21) Appl. No.: 10/442,010

(22) Filed: May 20, 2003

(65) Prior Publication Data

US 2004/0235705 A1 Nov. 25, 2004

(51) Int. Cl.
*C11D 3/50* (2006.01)

(52) U.S. Cl. ..... 510/101; 510/519; 510/520

(58) Field of Classification Search ..... 239/8, 239/9; 510/101, 516, 519, 520
See application file for complete search history.

(56) References Cited

U.S. PATENT DOCUMENTS

| | | | |
|---|---|---|---|
| 4,149,977 | A | 4/1979 | Morganson et al. |
| 4,346,840 | A | 8/1982 | Gaiser et al. |
| 4,424,134 | A | 1/1984 | Sissin et al. |
| 4,463,032 | A | 7/1984 | Arndt et al. |
| 4,521,541 | A | 6/1985 | Rutherford et al. |
| 4,715,970 | A | 12/1987 | Steltenkamp et al. |
| 4,769,397 | A | 9/1988 | Lapierre et al. |
| 4,973,422 | A | 11/1990 | Schmidt |
| 5,078,301 | A | 1/1992 | Gladfelter et al. |
| 5,145,595 | A | 9/1992 | Morris et al. |
| 5,198,198 | A | 3/1993 | Gladfelter et al. |
| 5,234,615 | A | 8/1993 | Gladfelter et al. |
| 5,540,853 | A | 7/1996 | Trinh et al. |
| 5,574,179 | A | 11/1996 | Wahl et al. |
| 5,783,657 | A | 7/1998 | Pavlin et al. |
| 5,998,570 | A | 12/1999 | Pavlin et al. |
| 6,133,226 | A | 10/2000 | Knowlton et al. |
| 6,213,409 | B1 | 4/2001 | Warren et al. |
| 6,235,705 | B1 | 5/2001 | Zembrodt et al. |
| 6,297,210 | B1 | 10/2001 | Hsu et al. |
| 6,432,896 | B1 | 8/2002 | Inaba et al. |
| 6,436,894 | B2 | 8/2002 | Zembrodt et al. |
| 6,451,065 | B2 | 9/2002 | Trinh et al. |
| 6,521,585 | B1 | 2/2003 | Yamashita et al. |
| 6,521,588 | B1 | 2/2003 | Katoh et al. |

(Continued)

FOREIGN PATENT DOCUMENTS

| | | |
|---|---|---|
| EP | 0 334 490 | 9/1989 |

(Continued)

*Primary Examiner*—John R. Hardee
(74) *Attorney, Agent, or Firm*—Joseph F. Leightner; Elizabeth Quirk

(57) ABSTRACT

Described is a method for imparting a substantive fragrance to fabrics being washed or dried in a washing machine or clothes dryer by means of tumbling the fabrics with one or more sachets, each of which contains fragrance-containing particles. The polymer particles comprise an ethylene-vinyl acetate copolymer, a blend of polyethylene and an ethylene/vinyl acetate copolymer, an ester-terminated polyamide, a blend of an ester-terminated polyamide and a polysaccharide and/or a $C_1$–$C_4$ alkyl methacrylate polymer. A method for producing fragrance-containing particles is also disclosed.

18 Claims, 9 Drawing Sheets

U.S. PATENT DOCUMENTS

| | | | |
|---|---|---|---|
| 6,521,589 | B2 | 2/2003 | Demeyere et al. |
| 6,528,471 | B1 | 3/2003 | Del Duca et al. |
| 6,528,474 | B1 | 3/2003 | Artiga Gonzalez et al. |
| 6,528,477 | B2 | 3/2003 | Kasturi et al. |
| 6,551,971 | B2 | 4/2003 | Inaba et al. |
| 6,551,976 | B1 | 4/2003 | Smith et al. |
| 6,551,979 | B1 | 4/2003 | Leonard et al. |
| 6,551,981 | B1 | 4/2003 | Ricci et al. |
| 6,551,982 | B1 | 4/2003 | Ricci et al. |
| 6,551,983 | B1 | 4/2003 | Welch et al. |
| 6,551,986 | B1 | 4/2003 | Littig et al. |
| 2001/0020001 | A1 | 9/2001 | Zembrodt et al. |

FOREIGN PATENT DOCUMENTS

| | | |
|---|---|---|
| EP | 0 395 151 | 4/1990 |
| EP | 1 178 107 | 2/2002 |
| EP | 1479757 | * 11/2004 |

* cited by examiner

METHOD FOR IMPARTING SUBSTANTIVE FRAGRANCE AND, OPTIONALLY, ANTI-STATIC PROPERTIES TO FABRICS DURING WASHING AND/OR DRYING PROCEDURE AND COMPOSITIONS USEFUL FOR EFFECTING SUCH PROCESSES

FIELD OF THE INVENTION

Our invention is directed to a method for imparting a substantive fragrance and, optionally, long-lasting anti-static properties to fabrics being washed in a washing machine during one or more washing cycles and/or fabrics being dried in a clothes dryer during one or more drying cycles, by means of tumbling the fabrics under heat (i) with one or more reusable convenient-to-handle three-dimensional sachets, each of which has the same or different dimensions and each of which (a) has a wall permeable to the passage of each of the components of a perfume composition and to the passage of anti-static agents, and (b) contains solid and/or visco-elastic particulate polymeric fragrance substances in the form of porous polymer particles each of which has an average effective diameter of from about 0.5 mm up to about 10 mm, preferably in the range of 0.5 mm$\leqq D_p \leqq$1.5 mm, or in the range of 3 mm$\leqq D_p \leqq$7 mm wherein $D_p$ represents the average effective particle diameter, and (ii) optionally, one or more anti-static agents separate from the sachet. The fragrance substances are individual aroma chemicals and/or multi-component fragrance compositions. The polymer particles may optionally include anti-static agents which are individual anti-static chemicals and/or multi-component anti-static compositions. The fragrance substance and the optional anti-static agent are efficaciously releasably absorbed in each of the polymer particles. The polymer particles useful in the practice of our invention, which may be puffed, using a blowing agent, have infrastructures composed of at least one of an ethylene-vinyl acetate copolymer, a blend of from about 90:10 up to about 10:90 wt.:wt ethylene polymers:ethylene-vinyl acetate copolymers, one or more ester-terminated polyamides, a blend of one or more ester-terminated polyamides and one or more polysaccharides such as maltodextrins and/or one or more $C_1$–$C_4$ alkyl methacrylate polymers. The polymers useful in the practice of our invention may optionally contain one or more fillers, one or more fragrance release promoters and/or one or more plasticizers. Our invention is also directed to novel compositions of matter containing one or more ester-terminated polyamides and urea and/or polysaccharides such as maltodextrins. Our invention is further directed to a novel method for producing ester-terminated polyamide particles having absorbed therein efficaciously controllably releasable fragrances and, optionally, one or more anti-static agents.

BACKGROUND OF THE INVENTION

The need for imparting substantive fragrances as well as anti-static properties to articles of clothing being washed and/or dried has been, over the past century, well-recognized in the prior art. Various attempts at fulfilling this need using various delivery systems have been disclosed in the prior art. There is a substantial presence in the international market place of fabric conditioning sheets containing perfumes and, in addition anti-static agents, for example products marketed under the trademark "ALL", trademark of Lever Brothers Company of Edgewater, N.J., described in U.S. Pat. Nos. 6,133,226 and 6,297,210, the specifications of which are herein incorporated by reference, the product disclosed in U.S. Pat. No. 5,145,595, the specification of which is herein incorporated by reference, and "CLINGFREE" trademark of Reckitt Benckiser N.V. of Schiphol, Netherlands. Furthermore, U.S. Pat. Nos. 6,436,894 and 6,235,705 the specifications of which are herein incorporated by reference disclose a process for providing anti-static and scent to clothes being laundered in a dryer by placing with the clothing being dried, a reusable mesh bag containing 'pearls' having a diameter of between 0.1 inches and 1 inch (2.54 mm up to 25.40 mm) composed of polyethylene and polypropylene which have absorbed therein perfume and anti-static agents which serve to dissipate an electrostatic charge on the clothing in order to avoid clothing 'cling' subsequent to the washing and/or drying operations. The disclosure of U.S. Pat. No. 6,436,894 indicates that a whitening agent such as titanium dioxide as well as a blowing agent can be added to the 'pearls'.

The use of currently marketed fabric softener "sheets" as exemplified herein as well as the use of particles, the infrastructures of which consist of unmodified polyethylene and/or polypropylene polymers disclosed in such patents as U.S. Pat. Nos. 6,436,894 and 6,235,705 has, however, been determined to be inadequate in providing efficacious delivery of the perfume and/or antistatic agents to fabrics being washed and/or dried. Furthermore, 'pearls' having effective diameters of greater than 10 millimeters as disclosed, for example, in U.S. Pat. Nos. 6,436,894 and 6,235,705, have been found to handicap the fabric washing and/or drying process as a result of intermittently causing the washing machine and dryer to go into an uncontrollable 'off-balance' mode during the washing and drying procedures.

Although polymeric perfume particles having effective diameters of from 0.5 mm up to 10 mm and having infrastructures fabricated from ethylene-vinyl acetate copolymers are disclosed to be useful in time release fragrance sachets for air freshening, particularly for use in clothes storage cabinets in U.S. Pat. No. 6,213,409, the disclosure of which is herein incorporated by reference. U.S. Pat. No. 6,213,409 does not disclose processes for utilizing reusable sachets containing polymeric fragrance particles for the purpose of imparting substantive fragrances to fabrics during any of the cycles of fabric washing and/or fabric drying operations.

THE INVENTION

Our invention provides a method for imparting a substantive fragrance and, optionally, anti-static properties to fabrics in a washing machine and/or in an automatic clothes dryer comprising tumbling said fabrics under heat at a temperature in the range of from about 40° C. up to about 100° C. in said washing machine and/or in said dryer with (a) at least one three-dimensional sachet article which evolves, during the washing cycle and/or during at least one drying cycle, an effective amount of a fragrance-imparting composition at an effective rate and, optionally, an effective amount of an anti-static property-imparting composition at an effective rate and, optionally, (b) an effective amount of an anti-static property-imparting composition separate from said sachet article, said three-dimensional sachet article comprising:

i. a non-rigid or substantially rigid hollow containment means consisting of a non-rigid or substantially rigid container wall which is a perforated or continuous, thin lamina separating an inner void from an outer environment totally surrounding said inner void; having a height of from about 4 up to about 10 cm. and a width of from about 1 up to about 10 cm and which is permeable to fragrance compositions and anti-static property-imparting compositions, each of the fragrance components of which fragrance compositions has a calculated C $\log_{10}$P of from about 1 up to about 8, said container wall optionally having absorbed therein and efficaciously removable therefrom at an effective rate, an effective amount of an anti-static property-imparting composition; and ii. contained within a major proportion of said inner void and supported by said non-rigid or substantially rigid perforated or continuous container wall, a plurality of polymeric fragrance composition and, optionally, anti-static property-imparting composition-containing and evolving solid or visco-elastic particles which have a total weight of from about 2 grams up to about 50 grams, each of which has an average effective diameter of from about 0.5 mm up to about 10 mm, said fragrance composition, and said optional anti-static property-imparting composition each being absorbed in the polymeric infrastructure of each of said polymeric particles, each of the components of said fragrance composition (A) being compatible with the polymer composing each of said polymeric infrastructures, (B) having a calculated C $\log_{10}$P of from about 1 up to about 8 and (C) having a boiling point at atmospheric pressure of greater than about 150° C., said fragrance composition being from about 5% up to about 45% by weight of said particles, the polymeric infrastructure of each of said particles comprising a polymer having a melting point greater than 80° C. and a number average molecular weight in the range of from about $5\times10^3$ up to about $1\times10^6$ selected from the group consisting of:

(a) at least one ethylene-vinyl acetate copolymer containing from about 10 up to about 90% vinyl acetate monomeric units;

(b) at least one blend of low density polyethylene and an ethylene-vinyl acetate copolymer, with the weight ratio of polyethylene:ethylene-vinyl acetate copolymer being from about 10:90 up to about 90:10 wherein the ethylene-vinyl acetate copolymer contains from about 10 up to 90% vinyl acetate monomeric units;

(c) at least one ester-terminated polyamide;

(d) a blend of at least one ester-terminated polyamide and at least one polysaccharide in a weight ratio range of from about 3:5 up to about 5:3; and (e) at least one $C_1$–$C_4$ alkyl methacrylate polymer;

wherein C $\log_{10}$P is the calculated logarithm to the base 10 of the n-octanol/water partition coefficient for each of the fragrance components of said fragrance composition.

Sachet articles useful in the practice of our invention may be fabricated in accordance with the teachings of U.S. Pat. No. 6,213,409. Two rectangular-shaped or triangular-shaped or circular-shaped or elliptically-shaped planar pre-fabricated portions of permeable polymer sheet or natural fiber, e.g. cotton-polyester polymer composite sheet having substantially identical dimensions, or non-woven fabric, for example non-woven polyester may be juxtaposed whereby their edges coincide about their respective perimeters. Initially, perfumed polymer particles are placed onto an intended surface of one of the pre-fabricated planar sheets, also herein referred to as "laminae". In the alternative, the pre-fabricated laminae may be fabricated from two closely-woven mesh lamina composed of a natural fiber such as cotton and/or a water-insoluble synthetic polymer such as polyethylene and/or polypropylene. The pre-fabricated sheets can be sewn together around their entire perimeters and/or they can be heat-sealed around their entire perimeters subsequent to introduction of the perfumed polymer particles. The pre-fabricated sheets may optionally have absorbed therein additional perfume components or compositions, and in addition the sheets may optionally have absorbed therein anti-static agents. The perfumed polymeric particles may have optionally absorbed therein, one or more efficaciously-releasable anti-static chemicals or anti-static compositions.

The perfumed polymeric particles useful in the practice of our invention may be fabricated from one or more of the following materials:

(a) at least one ethylene-vinyl acetate copolymer containing from about 10 up to about 90% vinyl acetate monomeric units;

(b) at least one blend of low density polyethylene and an ethylene-vinyl acetate copolymer, with the weight ratio of polyethylene:ethylene-vinyl acetate copolymer being from about 10:90 up to about 90:10 wherein the ethylene-vinyl acetate copolymer contains from about 10 up to 90% vinyl acetate monomeric units; and (c) at least one $C_1$–$C_4$ alkyl methacrylate polymer in accordance with the teachings of U.S. Pat. No. 4,521,541, the specification of which is herein incorporated by reference.

Preferably alkyl methacrylate resins useful in the practice of our invention are those disclosed in U.S. Pat. No. 4,463,032 the specification of which is herein incorporated by reference, particularly poly-isobutyl methacrylate cross-linked with 1,4-butanediol diacrylate or triallyl cyanurate having a number average molecular weight in the range of from about $8\times10^5$ to about $1.1\times10^6$.

In addition, perfumed polymeric particles useful in the practice of our invention may be fabricated from at least one ester-terminated polyamide according to Example V, or a blend of at least one ester-terminated polyamide and at least one polysaccharide such as a maltodextrin, for example MALTRIN M180, dextrose equivalent=18, registered trademark of Grain Processing Corporation of Muscatine, Iowa, in a weight ratio range of from about 3:5 to about 5:3. Examples of polyamides useful in the practice of our invention are UNICLEAR 100 and UNICLEAR 100V, trademarks of the Arizona Chemical Company of Panama City, Fla., each having a number average molecular weight of about 6000 and a softening point in the range of from 88° C. up to 94° C. prepared by reacting "x" equivalents of $C_{36}$ dicarboxylic acid, "y" equivalents of ethylene diamine and "z" equivalents of cetyl alcohol and/or stearyl alcohol wherein $$0.9 \le \left(\frac{x}{y+z}\right) \le 1.1 \text{ and } 0.1 \le \left(\frac{z}{y+z}\right) \le 0.7,$$

for example, as disclosed in U.S. Pat. No. 5,998,570; and amide terminated polyamides described in U.S. Pat. Nos. 6,268,466 and 6,469,131, the specifications are herein incorporated by reference.

The mean effective diameter of the perfumed polymeric particles may be in the range of from about 0.5 mm up to about 10 mm. Preferably, the mean effective diameter is in two separate ranges: from about 0.5 mm up to about 1.5 mm and from about 3 mm up to about 7 mm, with the most preferable mean effective diameter of the perfumed polymer particle being 1 mm.

When the sachet is placed in an automatic washing machine, it is either placed in the washer simultaneously with the fabric to be washed and the detergent and optionally anti-static agent, or subsequent to the emplacement in the washing machine of the fabric and detergent, and optionally anti-static agent. Examples of detergent articles and compositions useful in conjunction with the sachet article of our invention and useful in practicing the process of our invention are set forth in the following U.S. Patents, the specifications of which are herein incorporated by reference: U.S. Pat. Nos. 4,424,134; 5,574,179; 6,528,477; 6,528,471; 6,528,474; 6,521,589; 6,521,588; 6,521,585; 6,551,983; 6,551,986; 6,551,982, 6,551,979; 6,551,981, 6,551,971; and 6,551,976 disclosing detergent tablets.

When the sachet article of our invention is placed in an automatic dryer initially, or subsequent to leaving the washer along with washed fabrics, or during one of several, e.g. ten dryer cycles, optionally, an anti-static agent introduction may accompany the introduction of the sachet article. In addition, the sachet envelope may contain such anti-static agents, and the polymeric fragrance particles may contain such anti-static agents. Examples of the anti-static agents useful in the practice of our invention are those set forth in U.S. Pat. Nos. 6,436,894; 6,235,705; 6,297,210; 5,145,595 and 6,133,226. Preferable anti-static agents include laurylalkanolamides and tertiary ethoxylated cocoamines and tallow amines such as ARMOSTAT 300 and ARMOSTAT 400, trademarks of Akzo Nobel Chemicals, B.V. of Amersfoort, Netherlands.

The polymeric fragrance particles useful in the practice of our invention may contain in addition, blowing agents, plasticizers, fragrance release promoters and fillers. A number of materials have dual functions. Each of these materials is introduced during the polymer extrusion unit operation along with the fragrance material, as set forth in U.S. Pat. No. 4,521,541. Examples of blowing agents are set forth at column 12, lines 52–68 and column 13, lines 1–22 and include, for example, azo bis(formamide) and dichlorodifluoromethane. The blowing agent, HYDROCEROL trademark of Clariant, A.G. of Muttenz, Switzerland which is a mixture containing 45% sodium bicarbonate, 45% by weight citric acid and 10% by weight beeswax as described in U.S. Pat. No. 4,769,397. Examples of fragrance release promoters are paraffin wax and polysaccharides such as maltodextrins, for example, MALTRIN M-180. Examples of fillers are $CaCO_3$, activated carbon, silica and urea. Calcium carbonate also has substantial fragrance-release promotion properties when used with the polymeric fragrance particle-containing sachets in the process of our invention. The mixture of urea and ester-terminated polyamides is a novel composition used in our invention. Examples of plasticizers are isopropyl myristate, diethyl phthalate, dibutyl phthalate, benzyl benzoate, mineral oil, a methyl ester of a vegetable-derived $C_{12}$–$C_{18}$ carboxylic acid, for example, soybean methyl ester, the methyl ester of a mixture of 26% oleic acid, 49% linleic acid, 11% linolenic acid and 14% saturated fatty acids and a glyceryl ester of a vegetable-derived $C_{10}$ carboxylic acid, preferably the triglyceride of a 50:50 mixture of caprylic acid and capric acid marketed under the trademark, NEOBEE-M5 by the Stepan Chemical Company of Northfield, Ill.

When carrying out the process of our invention, the release of fragrance vs. time or vs. dryer cycle number can be expressed as a mathematical model wherein the % weight loss of fragrance Y vs. number of drying cycles, X is in accordance with the model:

$$Y=A\log_e X+B$$

wherein A is in the range of from about 2.5 up to about 10.5 and B is in the range of from about 1.5 up to about 31.5 and, wherein the % weight loss of fragrance Y vs. the days of dryer operation, θ is in accordance with the model:

$$Y=-\alpha e^{-\beta\theta}+\gamma$$

wherein α is in the range of from about 3.0 up to about 4.5; β is in the range of from about 0.030 up to about 0.045 and γ is in the range of from about 2.5 up to about 5.5. The aforementioned ranges of the values of A, B, α, β and γ were determined using the data and specific mathematical models for Table II in Example II, Table IV(c) in Example III, and Table V(c) in Example IV.

As stated, each of the efficaciously releasable components of the fragrance composition absorbed into the pores of the polymeric particles contained in the sachets of our invention has a C $\log_{10}P$ (calculated logarithm of base 10 of the n-octanol/water partition coefficient) of between 1 and 8, according to the inequality: $1 \leqq C\log_{10}P \leqq 8$. The range of fragrance composition in the polymeric particle is from about 5% by weight of the particle up to about 45% by weight of the particle. The values of $\log_{10}P$ with respect to fragrance components are discussed in detail in U.S. Pat. Nos. 5,540,853 and 6,451,065 the specifications of which are incorporated herein by reference. Specific examples of fragrance components useful in the practice of our invention and the value of the C $\log_{10}P$'s thereof are as follows:

| Fragrance Component | C $\log_{10}P$ value |
|---|---|
| benzaldehyde | 1.480 |
| cis-jasmmone | 2.712 |
| benzophenone | 3.120 |
| nerol | 2.649 |
| myristicin | 3.200 |
| amyl salicylate | 4.601 |
| cedryl acetate | 5.436 |
| cyclopentadecanolide | 6.246 |
| linalyl benzoate | 5.233 |
| β-caryophyllene | 6.333 |

Figure 3:
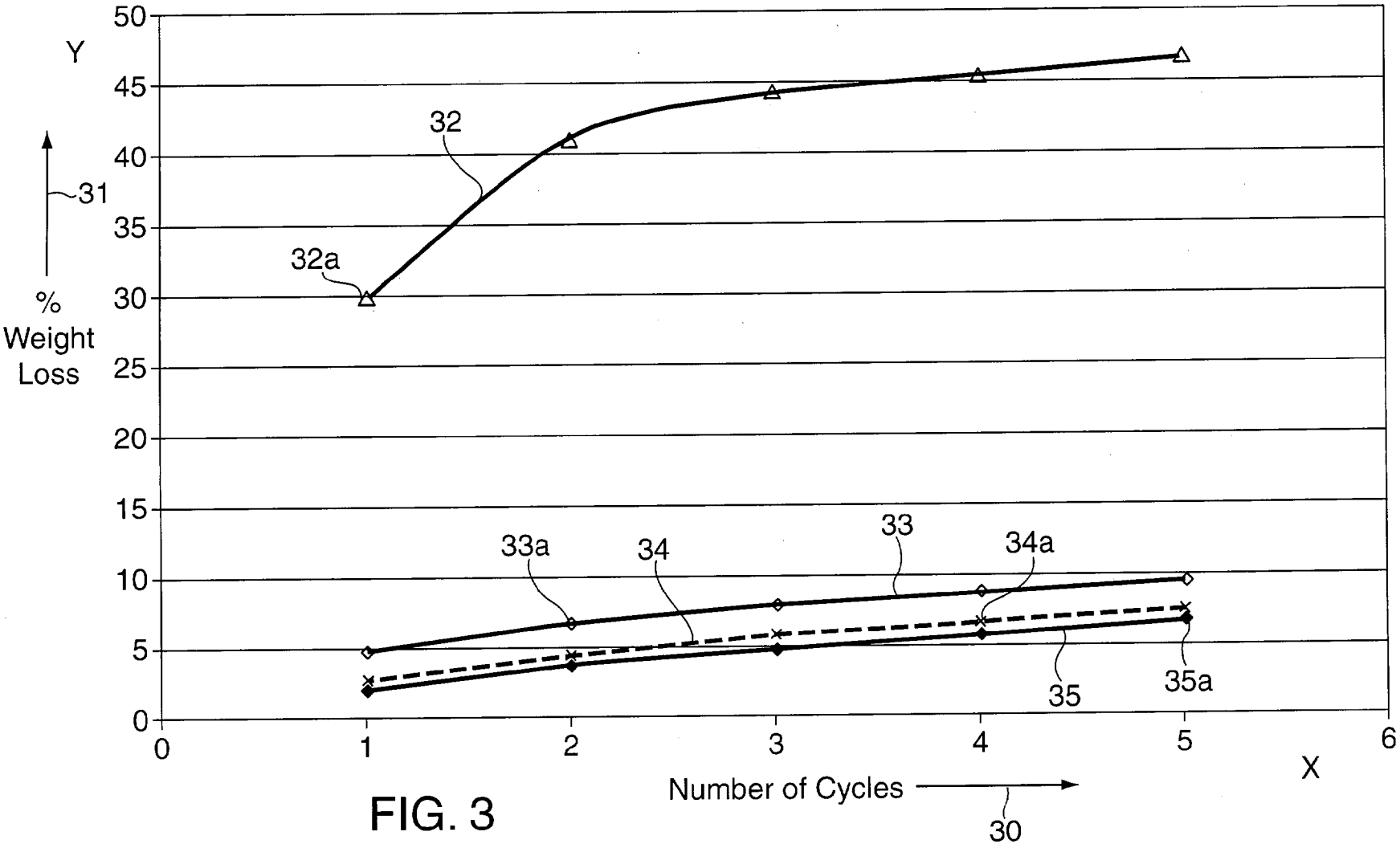

FIG. 3 is a set of four graphs showing on the "Y" or vertical axis, % fragrance composition weight loss, based on total initial weight of fragrance composition present in the sachet vs. number of drying cycles when drying fabrics in an automatic clothes dryer on the "X" axis or horizontal axis when carrying out the process of our invention according to Example II using four different sachets, one for each graph. Each sachet contains polymeric fragrance particles each of which has an average effective diameter of from 3 mm up to 7 mm, having (a) infrastructures composed of polymers or polymer blends or (b) fragrance concentrations in each of the polymers or polymer blends being different from those of the other sachets.

Figure 4:
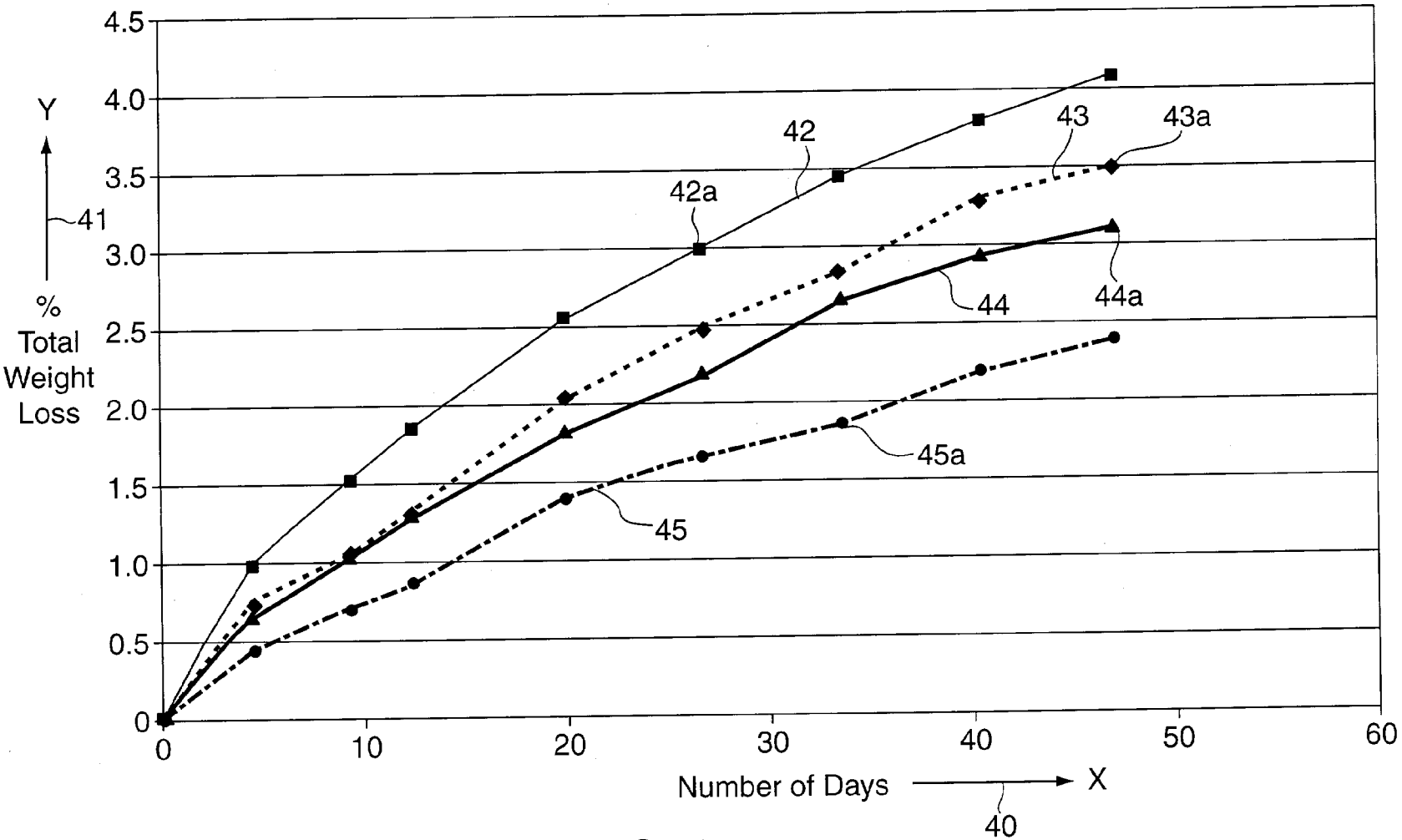

FIG. 4 is a set of four graphs each showing % average cumulative weight loss measured in units of grams lost/gram/day on the "Y" axis or vertical axis vs., on the "X" axis or horizontal axis, number of days of use of polymeric fragrance particles (a) having two different average effective diameters: 1 mm vs. a range of from about 3 mm to about 7 mm, at two different temperatures: 25° C. and 40° C., in accordance with Example IV.

Figure 5:
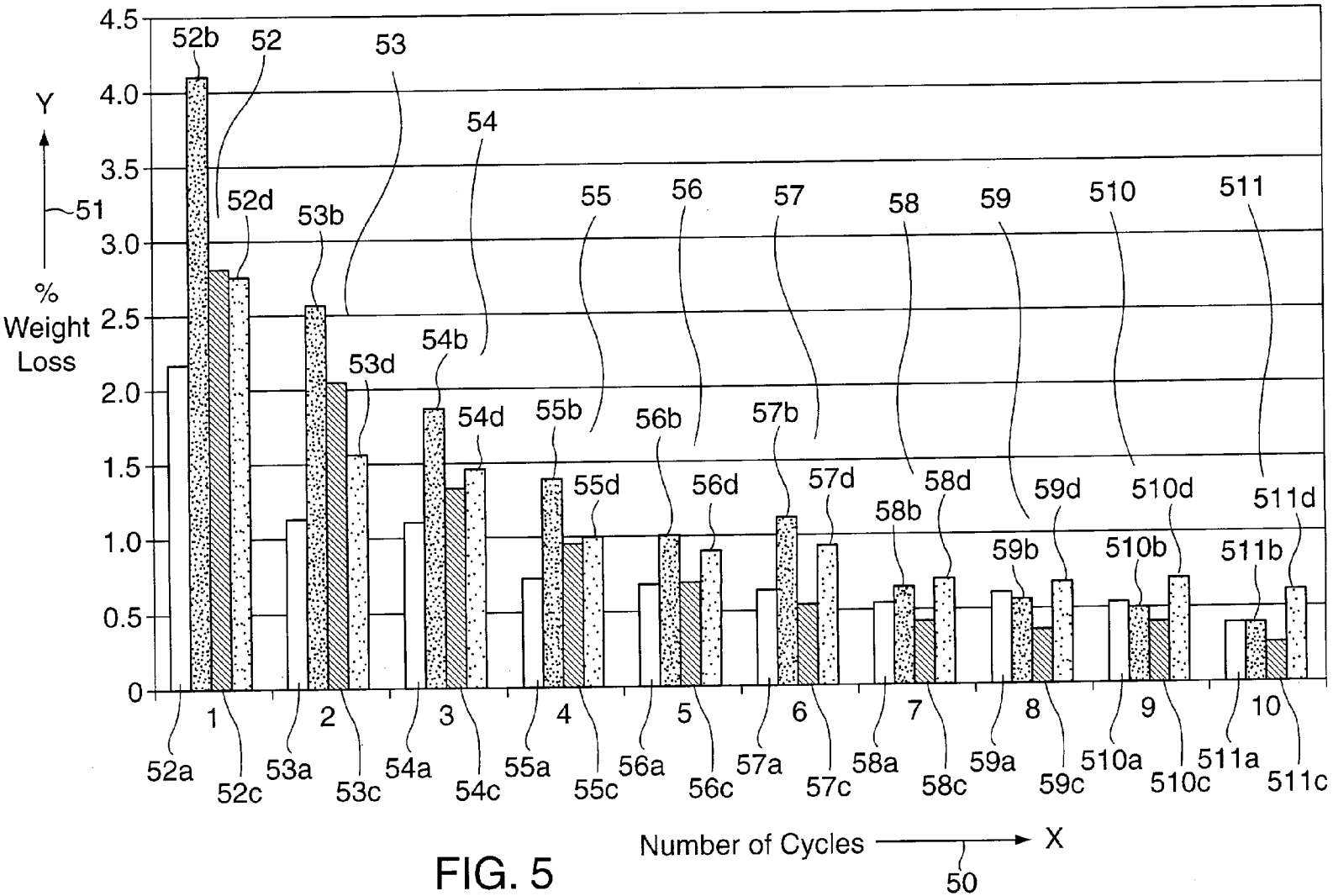

FIG. 5 is a series of ten groups of bar graphs, with each group having four bar graphs each of which is for a different sachet. FIG. 5 shows an incremental release profile for 10 drying cycles, showing on the "Y" axis or vertical axis % incremental weight loss of fragrance, based on initial weight of fragrance contained within the polymeric fragrance particles held in a sachet vs. number of cycles on the "X" axis or horizontal axis, in accordance with Example III. Each of the sachets contains polymeric fragrance particles each of which has an average effective diameter of 1 mm having (a) infrastructures composed of polymers or polymer blends; or (b) fragrance concentrations in each of the polymers or polymer blends; or (c) a sachet support structure being different from those of the other sachets.

Figure 6:
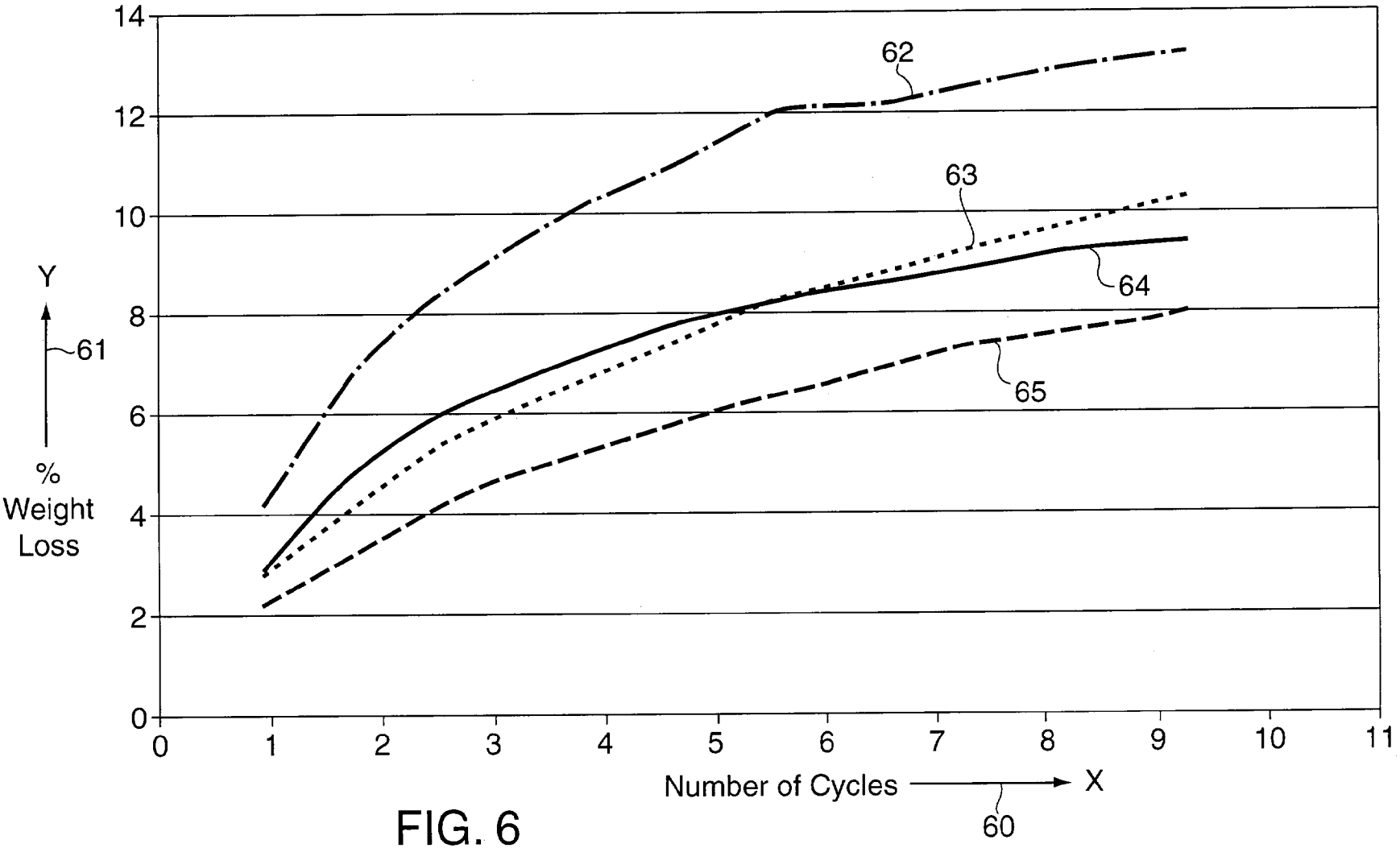

FIG. 6 is a set of four graphs showing on the "Y" or vertical axis, % cumulative fragrance composition weight loss, based on total initial weight of fragrance composition present in the sachet vs. number of drying cycles when drying fabrics in an automatic clothes dryer on the "X" axis or horizontal axis, when carrying out the process of our invention according to Example III using four different sachets, one for each graph. Each of the sachets contains polymeric fragrance particles each of which has an average effective diameter of 1 mm having (a) infrastructures composed of polymers or polymer blends; or (b) fragrance concentrations in each of the polymers or polymer blends; or (c) a sachet support structure being different from those of the other sachets.

Figure 7:
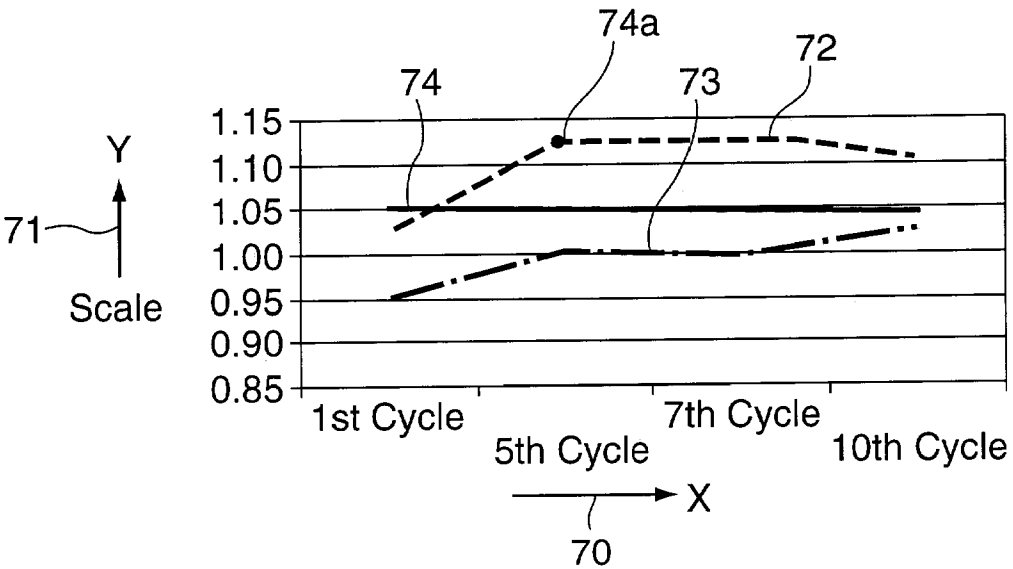

FIG. 7 is a set of three graphs setting forth comparative heat dry hedonics data for 10-cycle clothes dryer treatment of (i) two separate quantities of fabric accompanied by, respectively, two different sachets of our invention each containing polymeric fragrance particles, each of which (a) has an average effective diameter of from about 3 mm to about 7 mm and (b) a polymer infrastructure chemically different from the other, and (ii) fabric accompanied by the commercial dryer fabric softener sheet, known as SUAVITEL, trademark of the Colgate Palmolive Company of New York, N.Y. FIG. 7, as set forth in Example I shows preference, with respect to the dryer-treated fabric, on a scale of "0" up to "5" on the "Y" axis or vertical axis, with the "most preferred" value being a "5". The scale is presented as 0.85 to 1.15 to provide better resolution of the data. On the "X" axis or horizontal axis, the number of drying cycles using the same sachet of our invention or SUAVITEL dryer sheet, the maximum number of drying cycles being 10 in number.

Figure 8:
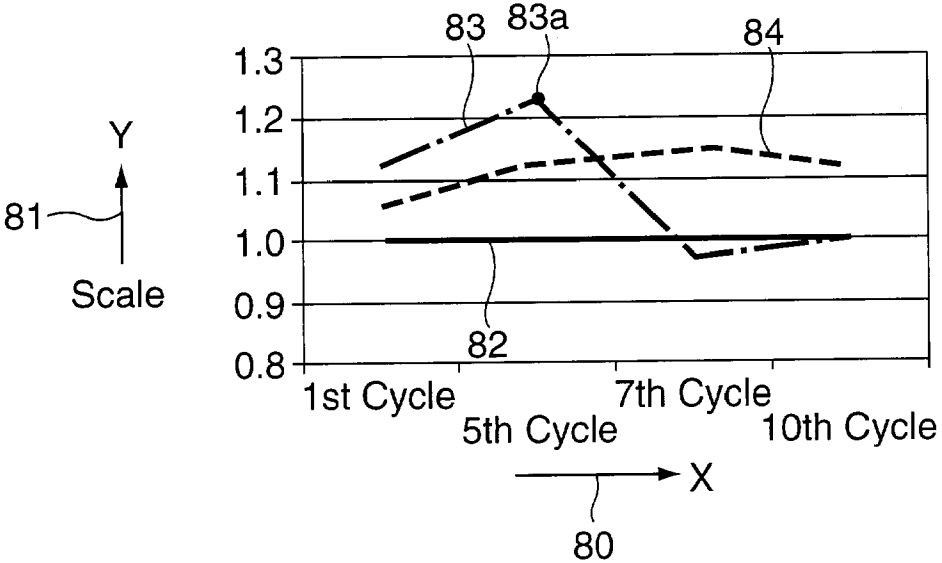

FIG. 8 is a set of three graphs setting forth comparative heat dry strength data for 10-cycle clothes dryer treatments of (i) two separate quantities of fabric accompanied by, respectively, two different sachets of our invention each containing polymeric fragrance particles, each of which (a) has an average effective diameter of from about 3 mm to about 7 mm and (b) a polymer infrastructure chemically different from the other, and (ii) a quantity of fabric using the commercial dryer fabric softener sheet, known as SUAVITE. FIG. 8, as set for in Example I shows fragrance strength, with reference to the drier-treated fabric, on a scale of "0" up to "5" on the "Y" axis or vertical axis, with the "greatest strength" value being a "5". The Y axis is presented as 0.8 to 1.3 to provide better resolution of the data. On the "X" axis the number of drying cycles using the sachet of our invention or a SUAVITEL dryer sheet is provided, the maximum number of drying cycles being 10 in number.

Figure 9:
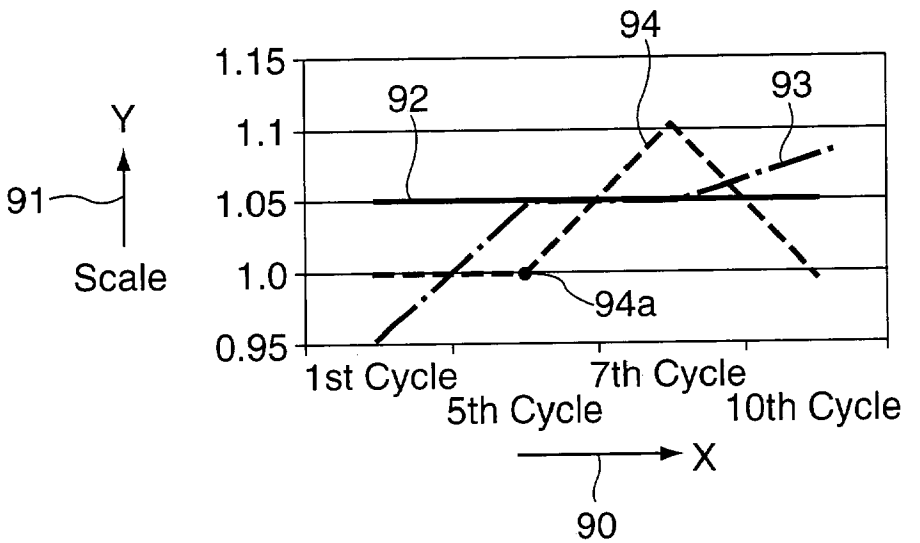

FIG. 9 is a set of three graphs setting forth comparative "point-of-purchase of fragrancing article" hedonics data for 10-cycle clothes dryer treatment of (i) two separate quantities of fabric accompanied by, respectively, two different sachets of our invention each containing polymeric fragrance particles, each of which (a) has an average effective diameter of from about 3 mm to about 7 mm and (b) a polymer infrastructure chemically different from the other, and (ii) fabric accompanied by the commercial dryer fabric softener sheet, known as SUAVITEL. FIG. 9, as set forth in Example I shows preference, with respect to the fragrancing article, e.g., the sachet of our invention or the fabric softening sheet, SUAVITEL, on a scale of "0" up to "5" depicted as 0.95 to 1.15 to provide greater resolution on the "Y" axis or vertical axis, with the "most preferred" value being a "5" vs. number of drying cycles using the same sachet of our invention or SUAVITEL dryer sheet on the "X" axis or horizontal axis, the maximum number of drying cycles being 10 in number.

Figure 10:
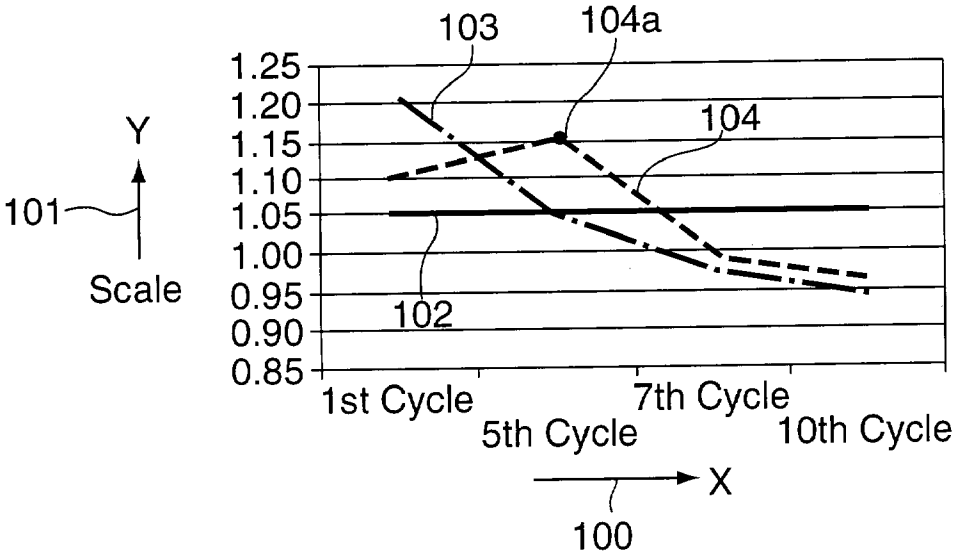

FIG. 10 is a set of three graphs setting forth comparative "point-of-purchase of fragrancing article" strength data for 10-cycle clothes dryer treatments of (i) two separate quantities of fabric accompanied by, respectively, two different sachets of our invention each containing polymeric fragrance particles, each of which (a) has an average effective diameter of from about 3 mm to about 7 mm and (b) a polymer infrastructure chemically different from the other, and (ii) a quantity of fabric using the commercial dryer fabric softener sheet, known as SUAVITEL. FIG. 10 as set forth in Example I shows fragrance strength, with reference to the to the fragrancing article, e.g., the sachet of our invention or the fabric softening sheet, SUAVITEL, on a scale of "0" up to "5" depicted as 0.85 to 1.25 to provide greater on the "Y" axis or vertical axis, with the "greatest strength" value being a "5" vs. number of drying cycles using the sachet of our invention or a SUAVITEL dryer sheet on the "X" axis or horizontal axis, the maximum number of drying cycles being 10 in number.

DETAILED DESCRIPTION OF THE DRAWINGS AND EXAMPLES

Figure 1A:
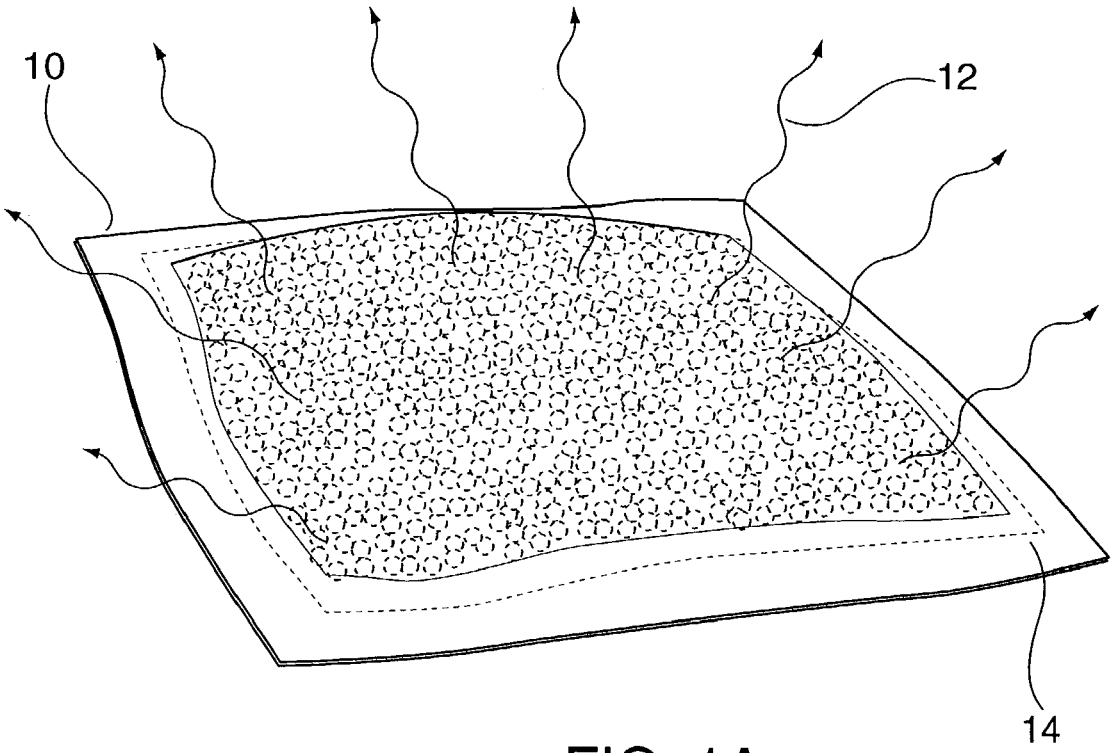
FIG. 1A is a perspective view of a reusable sachet article useful in the practice of our invention.
Figure 1B:
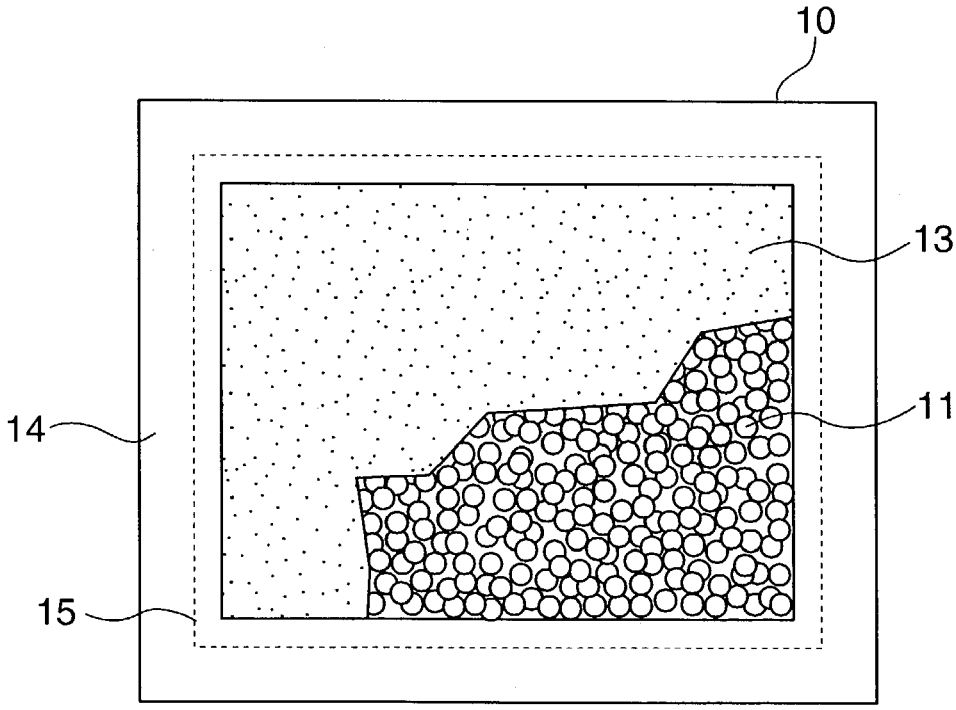
FIG. 1B is a cut-away side elevation view of the reusable sachet of FIG. 1A, exposing the polymeric fragrance particles containing optional anti-static agents contained within the sachet.

Referring to the sachet articles useful in the practice of our invention as illustrated in FIGS. 1A and 1B and referred to using reference numeral 10, two rectangular-shaped planar pre-fabricated portions of permeable polymer sheet 13 having substantially identical dimensions, or non-woven fabric, for example non-woven polyester are juxtaposed whereby their edges coincide along edges 14 and then heat sealed at 15 after placing perfumed polymer particles 11 onto the intended inner surface of one of the pre-fabricated sheets. In the alternative, the pre-fabricated portions, 13, may be fabricated from a woven mesh such a cotton and/or polyethylene or polypropylene. In that case, the pre-fabricated sheets 13 are sewn together at 15. The perfumed polymer particles 11 having average effective diameters of from about 0.5 mm to about 10 mm are fabricated according to the procedures of U.S. Pat. No. 4,521,541. Subsequent to fabrication of the sachets, 10, fragrance composition 12 is released from the perfumed polymeric particles 11 on a continuing basis into the environment surrounding the sachet, 10. Optionally, the polymer particles may also contain anti-static agent. Furthermore, optionally, when the prefabricated rectangular planar sheets 13 are fabricated from polymers such as polyesters or polyamides, the polyesters or polyamides may contain controllably releaseable anti-static agents as well as fragrances.

Figure 2A:
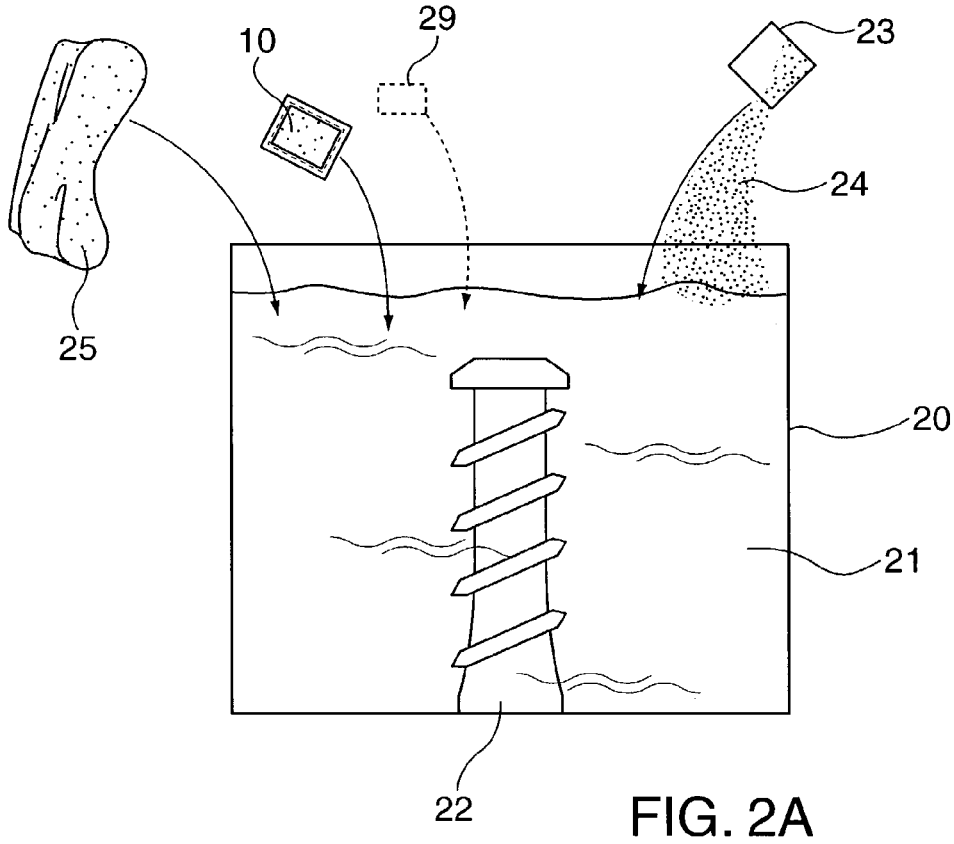
FIG. 2A is a schematic diagram showing the process of our invention when treating fabrics using a polymeric fragrance particle-containing reusable sachet article of FIG. 1A in a washing machine procedure.
Figure 2B:
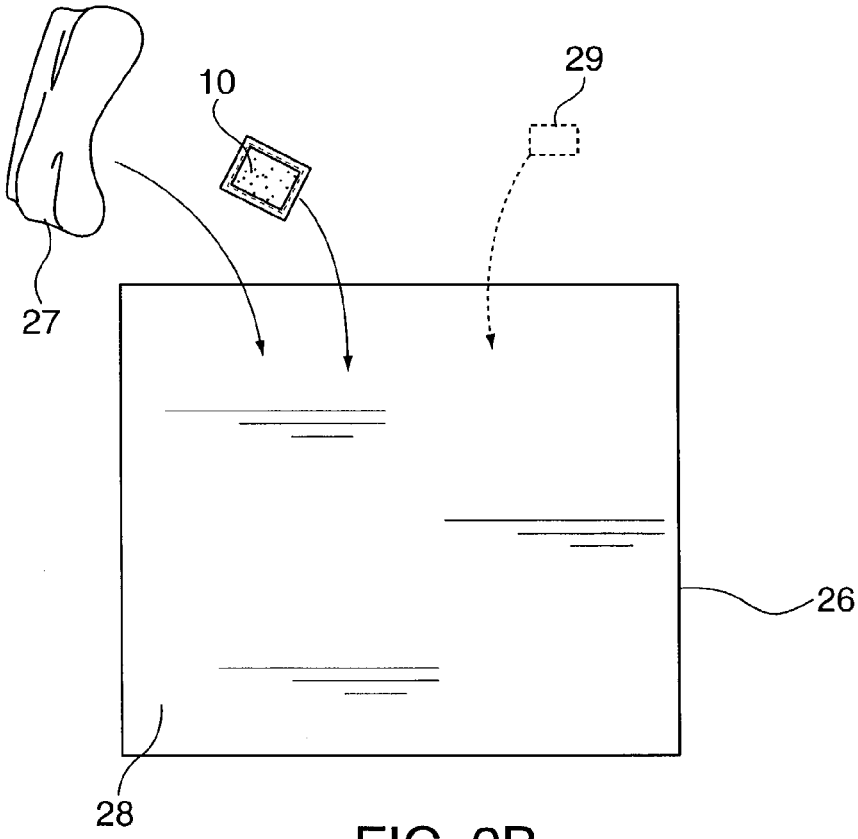
FIG. 2B is a schematic diagram showing the process of our invention when treating fabrics using a polymeric fragrance particle-containing reusable sachet article of FIG. 1A in a drying procedure using an-automatic dryer.
Figure 2C:
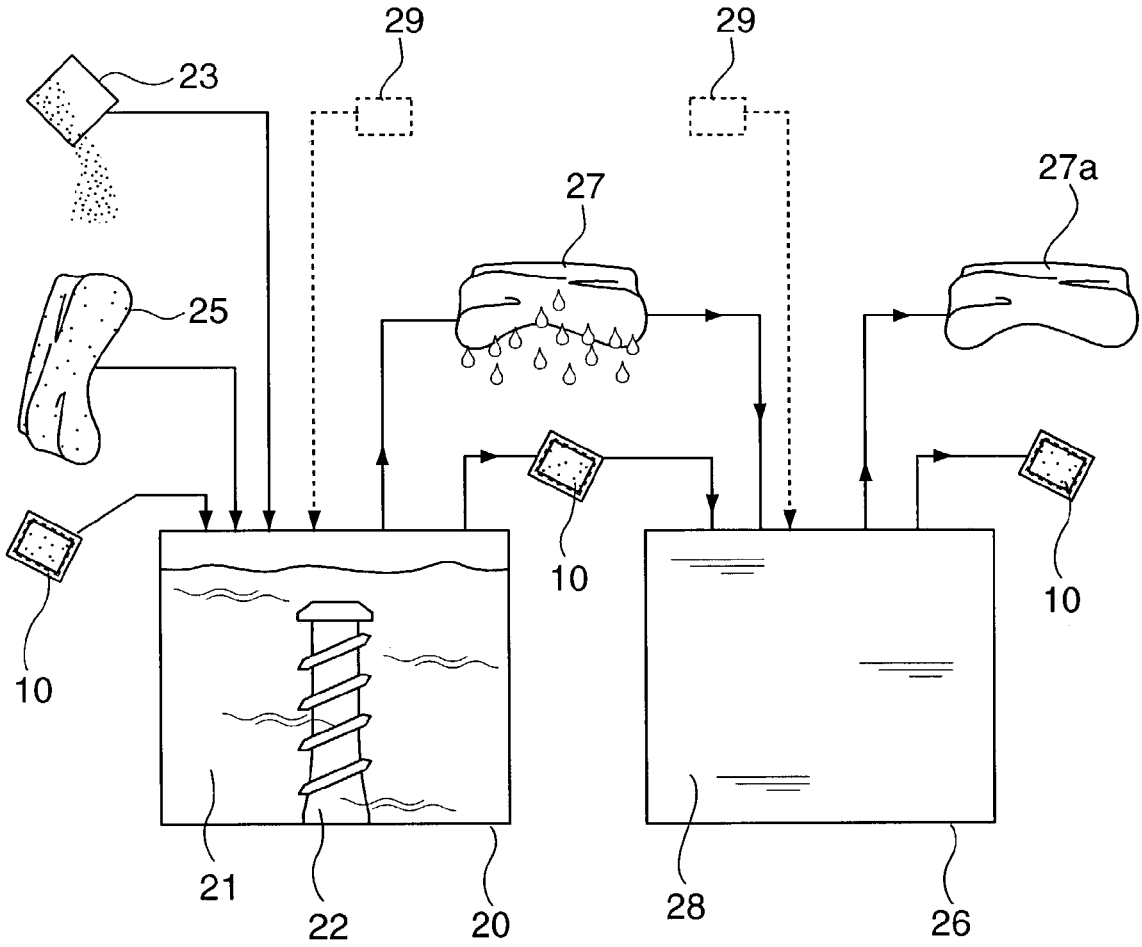
FIG. 2C is a schematic diagram showing the process of our invention when treating fabrics using a polymeric fragrance particle-containing reusable sachet article of FIG. 1A in a washing machine procedure followed by a drying procedure using an automatic dryer with the same sachet being employed in both the washing procedure and the drying procedure.

Use of the sachet article 10 in accordance with the process of our invention, is illustrated schematically in FIGS. 2A, 2B and 2C. In FIG. 2A, fabric 25, together with sachet article 10 and detergent powder 24 and, optionally, anti-static agent 29 are introduced, either simultaneously or in seriatim into the inner part, 21 of washing machine 20, prior to commencement of the washing cycle from, for example, detergent supply container 23. In the alternative, the sachet article 10 useful in the practice of our invention may be introduced during the washing cycle, or during the rinse cycle. Referring to FIG. 2B, washed and rinsed fabric 27, sachet article 10 and, optionally, anti-static agent 29 are introduced, either simultaneously or in seriatim into the inner part, 28, or automatic clothing dryer 26 prior to the commencement of the first drying cycle. In the alternative, the sachet article, 10, useful in the practice of our invention, may be introduced into dryer 26 during any one of the first drying cycle, or any subsequent drying cycles. Furthermore, in accordance with the practice of our invention, sachet article 10 may accompany the fabrics being dried, 27, through each drying cycle commencing with the first drying cycle. Referring to FIG. 2C, fabric to be washed, 25, sachet article, 10, detergent from container 23 and, optionally, anti-static agent 29 are simultaneously introduced into the inner part, 21 of washing machine 20 containing agitator 22. In the alternative, the sachet article 10 useful in the practice of our invention may be introduced during the washing cycle, or during the rinse cycle. Immediately subsequent to cessation of the final washing cycle, e.g., the rinsing cycle, sachet article 10 together with the washed and rinsed fabrics 27, are introduced, optionally, together with anti-static agent 29 are simultaneously introduced into the inner part, 28 of automatic clothes dryer 26. The sachet article 10, may accompany the fabrics through each drying cycle. Subsequent to the final drying cycle, sachet article 10 together with dried fabrics having fragrance imparted thereto, 27*a* are removed from dryer 26.

EXAMPLE A

Preparation of Fragrance for use with Microporous Polymer Particles in Examples I–V The following fragrance is prepared for use with sachets employed in Examples I–V:

| Ingredients | Parts by Weight |
|---|---|
| α-irone | 7.0 |
| myristicin | 4.0 |
| 2-methoxynaphthalene | 3.0 |
| benzaldehyde | 2.0 |
| β-phenylethyl alcohol | 12.0 |
| nerol | 7.0 |
| eugenol | 8.0 |
| isoeugenol | 2.0 |

EXAMPLE I

Sachets 10 as illustrated in FIGS. 1A and 1B are fabricated from non-woven porous 50:50 wt.:wt.alkyl polyester/cotton prefabricated laminas 13 according to the procedure set forth in paragraph 1 of the "DETAILED DESCRIPTION OF THE DRAWINGS", describing in detail said FIGS. 1A and 1B. The sachets each have an outer length of 8.0 cm., an outer width of 8.0 cm, an inner width between heat seals 15 of 5.9 cm., an inner length between heat seals 15 of 7.5 cm., an average thickness of 0.3 cm, and a wall thickness of 0.02 mm containing 6.5 gm. of microporous polymer particles (a) having polymer compositions, (b) containing the fragrance of Example A in concentrations, and (c) having dimensions, as set forth in each of this Example, I, and the specific Examples II and III.

Ten 12 inch×36 inch towels, and 1 cup of PUREX, trademark of Dial Corporation, Phoenix, Ariz., non-fragranced detergent are placed in a General Electric washing machine (i) at 'high' water level, (ii) at 'cold-warm' water temperature and (iii) at 'normal' wash. The resulting washed towels are placed in a General Electric dryer along with one sachet produced as set forth supra, at 'cotton' setting for 60 minutes per cycle. At the end of each cycle, the towels are removed for sensory testing and sachets are removed for sensory testing and then replaced in the dryer for measurement at the end of the subsequent cycle. Hedonic and strength results on a scale of "0", "least preferred" or weakest, to "5" most preferred or "having the most strength" are set forth in FIGS. 7, 8, 9 and 10, compared with the use of a SUAVITEL fabric softener sheet. In addition, for the purposes of Examples II and III, % weight loss of fragrance based on original weight of fragrance contained in the polymeric fragrance particle is measured by weighing the sachet at the end of each drying cycle for each type of sachet.

Referring to FIG. 7, the "Y" axis showing the hedonics scale for fragranced towels taken from the dryer is indicated by reference numeral 71 and the "X" axis for the number of drying cycles is indicated by reference numeral 70. The graph for heat dry hedonics for towels treated with SUAVITE fabric softener sheets is indicated by reference numeral 72. The graph for heat dry hedonics data for towels treated with sachets containing non-blown polymeric fragrance particles containing 20% fragrance of Example A, 50% low density polyethylene and 30% copolymer of ethylene and vinyl acetate having a ratio of 60:40 ethylene repeating units:vinyl acetate repeating units is indicated by reference numeral 74 with the illustrative data point for the measurement at the fifth dryer cycle being indicated by reference numeral 74*a*. The graph for heat dry hedonics data for towels treated with sachets containing non-blown polymeric fragrance particles containing 30% fragrance of Example A and 70% copolymer of ethylene and vinyl acetate having a ratio of 60:40 ethylene repeating units:vinyl acetate repeating units is indicated by reference numeral 73.

Referring to FIG. 8, the "Y" axis showing the strength scale for fragranced fabric taken from the dryer is indicated by reference numeral 81 and the "X" axis for the number of drying cycles is indicated by reference numeral 80. The graph for heat dry strength data for fabric treated with SUAVITEL fabric softener sheets is indicated by reference numeral 82. The graph for heat dry strength data for fabric treated with sachets containing non-blown polymeric fragrance particles containing 20% fragrance of Example A, 50% low density polyethylene and 30% copolymer of ethylene and vinyl acetate having a ratio of 60:40 ethylene repeating units:vinyl acetate repeating units is indicated by reference numeral 84. The graph for heat dry strength for fabrics treated with sachets containing non-blown polymeric fragrance particles containing 30% fragrance of Example A and 70% copolymer of ethylene and vinyl acetate having a ratio of 60:40 ethylene repeating units:vinyl acetate repeating units is indicated by reference numeral 83 with the illustrative data point for the measurement at the fifth dryer cycle being indicated by reference numeral 83*a*.

Referring to FIG. 9, the "Y" axis showing the "point-of-purchase" hedonics scale for sachets taken from the dryer at the end of each cycle (and then replaced into the dryer) is indicated by reference numeral 91 and the "X" axis for the number of drying cycles is indicated by reference numeral 90. The graph for "point-of-purchase" hedonics data for SUAVITEL fabric softener sheets is indicated by reference numeral 92. The graph for "point-of-purchase" hedonics data for sachets containing non-blown polymeric fragrance particles containing 20% fragrance of Example A, 50% low density polyethylene and 30% copolymer of ethylene and vinyl acetate having a ratio of 60:40 ethylene repeating units:vinyl acetate repeating units is indicated by reference numeral 93. The graph for "point-of-purchase" hedonics data for sachets containing non-blown polymeric fragrance particles containing 30% fragrance of Example A and 70% copolymer of ethylene and vinyl acetate having a ratio of 60:40 ethylene repeating units:vinyl acetate repeating units is indicated by reference numeral 94 with the data point for the measurement at the fifth dryer cycle being indicated by reference numeral 94*a*.

Referring to FIG. 10, the "Y" axis showing the "point-of-purchase" strength scale for sachets taken from the dryer at the end of each cycle (and then replaced into the dryer) is indicated by reference numeral 101 and the "X" axis for the number of drying cycles is indicated by reference numeral 100. The graph for "point-of-purchase" strength data for SUAVITEL fabric softener sheets is indicated by reference numeral 102. The graph for "point-of-purchase" strength data for sachets containing non-blown polymeric fragrance particles containing 20% fragrance of Example A, 50% low density polyethylene and 30% copolymer of ethylene and vinyl acetate having a ratio of 60:40 ethylene repeating units:vinyl acetate repeating units is indicated by reference numeral 104 with the data point for the measurement at the fifth dryer cycle being indicated by reference numeral 104*a*. The graph for "point-of-purchase" strength data for sachets containing non-blown polymeric fragrance particles containing 30% fragrance of Example A and 70% copolymer of ethylene and vinyl acetate having a ratio of 60:40 ethylene repeating units:vinyl acetate repeating units is indicated by reference numeral 103.

EXAMPLE II

Using the sachets of FIGS. 1A and 1B as prepared using the procedure of Example I, the following Table I, the data for which is also set forth in four graphs in FIG. 3, indicated by reference numerals 32, 33, 34 and 35, indicates % cumulative weight loss of fragrance based on initial weight of fragrance composition in the polymeric fragrance particles for 10 dryer cycles using the indicated polymeric fragrance particles, each of which has an average effective diameter of from about 3 mm to about 7 mm, when drying and fragrancing the towels as indicated in Example I. The % weight loss of fragrance, based on the initial quantity of fragrance contained in the specified polymeric fragrance particles is shown on the "Y" axis, indicated by reference numeral 31 and the cycle number is set forth on the "X" axis of FIG. 3, indicated by reference numeral 30.

TABLE I

| Contents of Sachet | Sachet I.D.# + graph ref. numeral in FIG. 3 | Initial Wt. (gm.) | % Cumulative Weight Loss | | | | |
|---|---|---|---|---|---|---|---|
| | | | After 1 cycle (%) | After 2 cycles (%) | After 3 cycles (%) | After 4 cycles (%) | After 5 cycles (%) |
| Non-blown polymeric fragrance particles containing 20% fragrance of Example A, 50% low density polyethylene and 30% copolymer of ethylene and vinyl acetate having a ratio of 60:40 ethylene repeating units:vinyl acetate repeating units | A-1; Ref.35 | 10.998 | 1.995 | 3.623 | 4.700 | 5.636 | 6.653 |

TABLE I-continued

| Contents of Sachet | Sachet I.D.# + graph ref. numeral in FIG. 3 | Initial Wt. (gm.) | % Cumulative Weight Loss After 1 cycle (%) | After 2 cycles (%) | After 3 cycles (%) | After 4 cycles (%) | After 5 cycles (%) |
|---|---|---|---|---|---|---|---|
| Polymer of Sachet A-1 blown with nitrogen | B-1; Ref.33 | 10.020 | 4.624 | 6.603 | 7.822 | 8.695 | 9.434 |
| Polymer of Sachet A-1 containing 18% fragrance and 2% HYDROCEROL(*) | C-1; Ref.34 | 11.303 | 2.593 | 4.308 | 5.697 | 6.541 | 7.334 |
| Polymeric fragrance particles containing 20% fragrance of Example A and 80% poly n-butyl methacrylate having a number average molecular weight of $1 \times 10^6$ | D-1; Ref.32 | 11.340 | 29.689 | 40.979 | 44.176 | 45.383 | 46.515 |

Note (*)HYDROCEROL, a "blowing agent", is a trademark of Clariant A.G. of Muttenz, Switzerland; and is a blend consisting of 45% by weight of citric acid, 45% by weight of sodium bicarbonate and 10% by weight of beeswax, described in U.S. Pat. No. 4,769,397.

The following Table II sets forth, for each of the sachet polymeric fragrance particle types of Table I, a mathematical regression model based on the data in Table I:

TABLE II

| FIG. 3 Graph Reference Numeral and Identification Number | Mathematical Model |
|---|---|
| I.D.#A-1;Reference Numeral 35 | $Y = 2.82 \log_e X + 1.83$ |
| I.D.#B-1;Reference Numeral 33 | $Y = 2.98 \log_e X + 4.58$ |
| I.D.#C-1;Reference Numeral 34 | $Y = 2.95 \log_e X + 2.49$ |
| I.D.#D-1;Reference Numeral 32 | $Y = 10.37 \log_e X + 31.42$ |

Referring to FIG. 3, illustrative data points for graphs 32, 33, 34 and 35 are indicated by reference numerals 32*a*, 33*a*, 34*a* and 35*a*, respectively.

EXAMPLE III

Using the sachets of FIGS. 1A and 1B as prepared using the procedure of Example I, the following Tables III(a) and III(b) indicate % incremental weight loss of fragrance based on initial weight of fragrance composition in the polymeric fragrance particles for 10 dryer cycles using the indicated polymeric fragrance particles, each of which has an average effective diameter of 1 mm, when drying and fragrancing the towels as indicated in Example I. The data presented in Tables III(a) and III(b) are set forth in FIG. 5 in the form of groups of bar graphs, one group for each cycle, as follows: cycle 1-reference numeral 52; cycle 2-reference numeral 53; cycle 3-reference numeral 54; cycle 4-reference numeral 55; cycle 5-reference numeral 56; cycle 6-reference numeral 57; cycle 7-reference numeral 58; cycle 8-reference numeral 59; cycle 9-reference numeral 510; cycle 10-reference numeral 511. The % weight loss of fragrance, based on the initial quantity of fragrance contained in the specified polymeric fragrance particles is shown on the "Y" axis, indicated by reference numeral 51 and the cycle number is set forth on the "X" axis of FIG. 5, indicated by reference numeral 50.

In addition, using the sachets of FIGS. 1A and 1B as prepared using the procedure of Example I, the following Tables IV(a) and IV(b), the data for which is also set forth in four graphs in FIG. 6, indicated by reference numerals 62, 63, 64 and 65, indicate % cumulative weight loss of fragrance based on initial weight of fragrance composition in the polymeric fragrance particles for 10 dryer cycles using the indicated polymeric fragrance particles, each of which has an average effective diameter of 1 mm, when drying and fragrancing the towels as indicated in Example I. The % weight loss of fragrance, based on the initial quantity of fragrance contained in the specified polymeric fragrance particles is shown on the "Y" axis, indicated by reference numeral 61 and the cycle number is set forth on the "X" axis of FIG. 6, indicated by reference numeral 60. The following Table IV(c) sets forth, for each of the sachet-containing polymeric fragrance particle types of Tables III(a), III(b), IV(a) and IV(b), a mathematical regression model based on the data in Tables IV(a) and IV(b).

This example demonstrates the ability of the present invention to provide consistent release of fragrance after being used multiple times in a clothes dryer.

TABLE IIIa

| Contents of Sachet | Sachet I.D.# + bar graph ref. numeral in FIG. 5 | Initial Wt. (gm.) | % Incremental Weight loss and Corresponding Bar Graph Reference Numeral | | | | |
|---|---|---|---|---|---|---|---|
| | | | After 1 cycle (%) | After 2 cycles (%) | After 3 cycles (%) | After 4 cycles (%) | After 5 cycles (%) |
| Non-blown polymeric fragrance particles containing 20% fragrance of Example A, 50% low density polyethylene and 30% copolymer of ethylene and vinyl acetate having a ratio of 60:40 ethylene repeating units:vinyl acetate repeating units | A-3; Ref.52a, 53a,54a, 55a and 56a | 11.998 | 2.184 52a | 1.163 53a | 1.136 54a | 0.763 55a | 0.709 56a |
| Non-blown polymeric fragrance particles containing 30% fragrance of Example A and 70% copolymer of ethylene and vinyl acetate having a ratio of 60:40 ethylene repeating units:vinyl acetate repeating units | B-3; Ref.52b, 53b,54b, 55b and 56b | 11.963 | 4.112 52b | 2.584 53b | 1.903 54b | 1.430 55b | 1.049 56b |
| Non-blown polymeric fragrance particles containing 20% fragrance of Example A and 80% copolymer of ethylene and vinyl acetate having a ratio of 60:40 ethylene repeating units:vinyl acetate repeating units | C-3; Ref,52c, 53c,54c, 55c and 56c | 12.004 | 2.823 52c | 2.076 53c | 1.377 54c | 0.980 55c | 0.729 56c |
| Polymer particles of Sachet A-3 in Mesh Bag of FIG. 1 of U.S. Pat. No. 6,436,894 | D-3; Ref.52d, 53d, 54d, 55d, and 56d | 10.554 | 2.784 52d | 1.583 53d | 1.487 54d | 1.035 55d | 0.940 56d |

TABLE IIIb

| Contents of Sachet | Sachet I.D.# + bar graph ref. numeral in FIG. 5 | Initial Wt. (gm.) | % Incremental Weight Loss and Corresponding Bar Graph Reference Numeral | | | | |
|---|---|---|---|---|---|---|---|
| | | | After 6 cycles (%) | After 7 cycles (%) | After 8 cycles (%) | After 9 cycles (%) | After 10 cycles (%) |
| Non-blown polymeric fragrance particles containing 20% fragrance of Example A, 50% low density polyethylene and 30% copolymer of ethylene and vinyl acetate having a ratio of 60:40 ethylene repeating units:vinyl acetate repeating units | A-3; Ref .57a, 58a ,59a, 510a and 511a | 11.998 | 0.646 57a | 0.559 58a | 0.644 59a | 0.563 510a | 0.425 511a |
| Non-blown polymeric fragrance particles containing 30% fragrance of Example A and 70% copolymer of ethylene and vinyl acetate having a ratio of 60:40 ethylene repeating units:vinyl acetate repeating units | B-3; Ref.57b,58b, 59b, 510b and 511b | 11.963 | 1.164 57b | 0.675 58b | 0.596 59b | 0.516 510b | 0.427 511b |

TABLE IIIb-continued

| Contents of Sachet | Sachet I.D.# + bar graph ref. numeral in FIG. 5 | Initial Wt. (gm.) | % Incremental Weight Loss and Corresponding Bar Graph Reference Numeral | | | | |
|---|---|---|---|---|---|---|---|
| | | | After 6 cycles (%) | After 7 cycles (%) | After 8 cycles (%) | After 9 cycles (%) | After 10 cycles (%) |
| Non-blown polymeric fragrance particles containing 20% fragrance of Example A and 80% copolymer of ethylene and vinyl acetate having a ratio of 60:40 ethylene repeating units:vinyl acetate repeating units | C-3; Ref,57c, 58c, 59c, 510c and 511c | 12.004 | 0.576 57c | 0.456 58c | 0.387 59c | 0.442 510c | 0.315 511c |
| Polymer particles of Sachet A-3 in Mesh Bag of FIG. 1 of U.S. Pat. No. 6,436,894 | D-3; Ref.57d, 58d, 59d, 510d, and 511d | 10.554 | 0.973 57d | 0.733 58d | 0.714 59d | 0.734 510d | 0.640 511d |

TABLE IVa

| Contents of Sachet | Sachet I.D.# + bar graph ref. numeral in FIG. 6 | Initial Wt. (gm.) | % Cumulative Weight Loss | | | | |
|---|---|---|---|---|---|---|---|
| | | | After 1 cycle (%) | After 2 cycles (%) | After 3 cycles (%) | After 4 cycles (%) | After 5 cycles (%) |
| Non-blown polymeric fragrance particles containing 20% fragrance of Example A, 50% low density polyethylene and 30% copolymer of ethylene and vinyl acetate having a ratio of 60:40 ethylene repeating units:vinyl acetate repeating units | A-4; Ref.65 | 11.998 | 2.184 | 3.310 | 3.403 | 5.098 | 5.760 |
| Non-blown polymeric fragrance particles containing 30% fragrance of Example A and 70% copolymer of ethylene and vinyl acetate having a ratio of 60:40 ethylene repeating units:vinyl acetate repeating units | B-4; Ref..62 | 11.963 | 4.112 | 7.047 | 8.750 | 10.024 | 10.968 |
| Non-blown polymeric fragrance particles containing 20% fragrance of Example A and 80% copolymer of ethylene and vinyl acetate having a ratio of 60:40 ethylene repeating units:vinyl acetate repeating units | C-4; Ref.64 | 12.004 | 2.823 | 5.001 | 6.240 | 7.118 | 7.764 |
| Polymer particles of Sachet A-4 in Mesh Bag of FIG. 1 of U.S. Pat. No. 6,436,894 | D-4; Ref.63 | 10.554 | 2.784 | 4.262 | 5.671 | 6.563 | 7.396 |

TABLE IVb

| Contents of Sachet | Sachet I.D.# + bar graph ref. numeral in FIG. 6 | Initial Wt. (gm.) | % Cumulative Weight Loss After 6 cycles (%) | After 7 cycles (%) | After 8 cycles (%) | After 9 cycles (%) | After 10 cycles (%) |
|---|---|---|---|---|---|---|---|
| Non-blown polymeric fragrance particles containing 20% fragrance of Example A, 50% low density polyethylene and 30% copolymer of ethylene and vinyl acetate having a ratio of 60:40 ethylene repeating units:vinyl acetate repeating units | A-4; Ref.65 | 11.998 | 6.347 | 6.861 | 7.405 | 7.647 | 8.020 |
| Non-blown polymeric fragrance particles containing 30% fragrance of Example A and 70% copolymer of ethylene and vinyl acetate having a ratio of 60:40 ethylene repeating units:vinyl acetate repeating units | B-4; Ref.62 | 11.963 | 11.978 | 12.168 | 12.611 | 12.943 | 13.248 |
| Non-blown polymeric fragrance particles containing 20% fragrance of Example A and 80% copolymer of ethylene and vinyl acetate having a ratio of 60:40 ethylene repeating units:vinyl acetate repeating units | C-4; Ref.64 | 12.004 | 8.265 | 8.639 | 8.933 | 9.258 | 9.433 |
| Polymer particles of Sachet A-4 in Mesh Bag of FIG. 1 of U.S. Pat. No. 6,436,894 | D-4; Ref.63 | 10.554 | 8.245 | 8.783 | 9.341 | 9.864 | 10.343 |

TABLE IVc

| FIG. 6 Graph Reference Numeral and Identification Number | Mathematical Model |
|---|---|
| I.D.#A-4;Reference Numeral 65 | $Y = 2.63 \log_e X + 1.73$ |
| I.D.#B-4;Reference Numeral 62 | $Y = 4.03 \log_e X + 4.30$ |
| I.D.#C-4;Reference Numeral 64 | $Y = 2.89 \log_e X + 2.99$ |
| I.D.#D-4;Reference Numeral 63 | $Y = 3.37 \log_e X + 2.23$ |

EXAMPLE IV

Using the sachets of FIGS. 1A and 1B as prepared using the procedure of Example I, the following Tables V(a) and V(b), the data for which is also presented in the form of each of four graphs indicated by reference numerals 42, 43, 44 and 45 in FIG. 4, indicate % average cumulative weight loss of fragrance based on initial weight of fragrance composition in the polymeric fragrance particles. Thus, in FIG. 4 there are set forth four graphs each showing % average cumulative weight loss measured in units of grams lost/gram/day on the "Y" axis or vertical axis, indicated by reference numeral 41 vs., on the "X" axis or horizontal axis, indicated by reference numeral 40, the number of days of use of polymeric fragrance particles (a) having two different average effective diameters: 1 mm vs. a range of 3 mm–7 mm, at two different temperatures: 25° C. and 40° C., as specifically described in Tables V(a) and V(b). Illustrative data points on each of graphs 42, 43, 44 and 45 are indicated, respectively, by reference numerals 42*a*, 43*a*, 44*a* and 45*a*. The following Table V(c) sets forth, for each of the polymeric fragrance particle types of Tables V(a) and V(b), a mathematical regression model based on the data in Tables V(a) and V(b):

TABLE Va

| Contents of Sachet | Sachet I.D.# + graph ref. numeral in FIG. 4 | Initial % volat. + Temp. (° C.) | % Average Cumulative Weight Loss (gram lost/gram/day) 0 days | 4.72 days | 9.75 days | 12.92 days | 20.73 days |
|---|---|---|---|---|---|---|---|
| Non-blown polymeric fragrance particles having average effective diameter of 1 mm containing 20% fragrance of Example A, 50% low density polyethylene and 30% copolymer of ethylene and vinyl acetate having a ratio of 60:40 ethylene repeating units:vinyl acetate repeating units | A-5; Ref.42 | 15% 40° C. | 0.00 | 0.98 | 1.53 | 1.87 | 2.58 |
| Polymer of Sachet A-5 | B-5; Ref.43 | 15% 25° C. | 0.00 | 0.73 | 1.07 | 1.32 | 2.06 |
| Non-blown polymeric fragrance particles having average effective diameter of 3 mm–7 mm containing 20% fragrance of Example A, 50% low density polyethylene and 30% copolymer of ethylene and vinyl acetate having a ratio of 60:40 ethylene repeating units:vinyl acetate repeating units | C-5; Ref.44 | 15% 40° C. | 0.00 | 0.66 | 1.05 | 1.30 | 1.82 |
| Polymer of sachet C-5 | D-5; Ref.45 | 15% 25° C. | 0.00 | 0.45 | 0.70 | 0.87 | 1.40 |

TABLE Vb

| Contents of Sachet | Sachet I.D.# + graph ref. numeral in FIG. 4 | Initial % volat. + Temp. (° C.) | % Average Cumulative Weight Loss (gram lost/gram day) 0 days | 27.77 days | 34.81 days | 41.94 days | 48.76 days |
|---|---|---|---|---|---|---|---|
| Non-blown polymeric fragrance particles having average effective diameter of 1 mm containing 20% fragrance of Example A, 50% low density polyethylene and 30% copolymer of ethylene and vinyl acetate having a ratio of 60:40 ethylene repeating units:vinyl acetate repeating units | A-5; Ref.42 | 15% 40° C. | 0.00 | 3.01 | 3.48 | 3.85 | 4.11 |
| Polymer of Sachet A-5 | B-5; Ref.43 | 15% 25° C. | 0.00 | 2.50 | 2.87 | 3.32 | 3.53 |
| Non-blown polymeric fragrance particles having average effective diameter of 3 mm–7 mm containing 20% fragrance of Example A, 50% low density polyethylene and 30% copolymer of ethylene and vinyl acetate having a ratio of 60:40 ethylene repeating units:vinyl acetate repeating units | C-5; Ref.44 | 15% 40° C. | 0.00 | 2.21 | 2.68 | 2.97 | 3.15 |

TABLE Vb-continued

| Contents of Sachet | Sachet I.D.# + graph ref. numeral in FIG. 4 | Initial % volat. + Temp. (° C.) | % Average Cumulative Weight Loss (gram lost/gram day) 0 days | 27.77 days | 34.81 days | 41.94 days | 48.76 days |
|---|---|---|---|---|---|---|---|
| Polymer of sachet C-5 | D-5; Ref.45 | 15% 25° C. | 0.00 | 1.67 | 1.88 | 2.21 | 2.41 |

TABLE Vc

| FIG. 4 Graph Reference Numeral and Identification Number | Mathematical Model |
|---|---|
| I.D.#A-5;Reference Numeral 42 | $Y = -4.91e^{-0.034X} + 5$ |
| I.D.#B-5;Reference Numeral 43 | $Y = -4.39e^{-0.043X} + 4$ |
| I.D.#C-5;Reference Numeral 44 | $Y = -4.03e^{-0.032X} + 4$ |
| I.D.#D-5;Reference Numeral 45 | $Y = -3.12e^{-0.032X} + 3$ |

This example demonstrates the efficacy of the present invention in delivery of fragrance over time and the ability of the sachet to be used multiple times in the drying cycle.

EXAMPLE V

Preparation of Perfumed Polymeric Particles Fabricated from Ester-Terminated Polyamides 500 grams of the ester-terminated polyamide, UNICLEAR 100V, is melted at 90° C. and placed in a vessel equipped with an agitator and heating coils in order to maintain constant temperature. Simultaneously, 200 grams of the perfume composition of Example A is heated to 90° C. The fragrance is then poured into the molten UNICLEAR 100V with agitation at 50 rpm. After agitation is continued, keeping a constant temperature, for a period of 0.5 hours, the resulting fragrance-ester-terminated polyamide mixture is poured into 3000 milliliters of distilled water held in an insulated open vessel equipped with an agitator and cooling coils, at 3° C. thereby effecting precipitation of polymeric fragrance pellets each of which has an effective diameter of from about 3 mm to about 7 mm.

The pellets of the present invention when utilized in procedures as set forth in Examples I, II, III and IV yielding substantially the same beneficial results as those when sachets A-1, A-3, A-4 and A-5 are used with the towels described in Example I.

What is claimed is:

1. A method for imparting a substantive fragrance and, optionally, anti-static properties to fabrics in a washing machine and/or in an automatic clothes dryer comprising tumbling said fabrics under heat at a temperature in the range of from about 40° C. up to about 100° C. in said washing machine and/or in said dryer with (a) at least one three-dimensional sachet article which evolves, during the washing cycle and/or during at least one drying cycle, an effective amount of a fragrance-imparting composition at an effective rate and, optionally, an effective amount of an anti-static property-imparting composition at an effective rate and, optionally, (b) an effective amount of an anti-static property-imparting composition separate from said sachet article, said three-dimensional sachet article comprising:

i. a non-rigid or substantially rigid hollow containment means consisting of a non-rigid or substantially rigid container wall which is a perforated or continuous, thin lamina separating an inner void from an outer environment totally surrounding said inner void; having a height of from about 4 up to about 10 cm. and a width of from about 1 up to about 10 cm and which is permeable to fragrance compositions and anti-static property-imparting compositions, each of the fragrance components of which fragrance compositions has a calculated C $\log_{10}P$ of from about 1 up to about 8, said container wall optionally having absorbed therein and efficaciously removable therefrom at an effective rate, an effective amount of an anti-static property-imparting composition; and ii. contained within a major proportion of said inner void and supported by said non-rigid or substantially rigid perforated or continuous container wall, a plurality of polymeric fragrance composition and, optionally, anti-static property-imparting composition-containing and evolving solid or visco-elastic particles which have a total weight of from about 2 grams up to about 50 grams, each of which has an average effective diameter of from about 0.5 mm up to about 10 mm, said fragrance composition, and a filler selected from the group consisting of $CaCO_3$, activated carbon, silica and urea, and said optional anti-static property-imparting composition each being absorbed in the polymeric infrastructure of each of said polymeric particles, each of the components of said fragrance composition (A) being compatible with the polymer composing each of said polymeric infrastructures, (B) having a calculated C $\log_{10}P$ of from about 1 up to about 8 and (C) having a boiling point at atmospheric pressure of greater than about 150° C., said fragrance composition being from about 5% up to about 45% by weight of said particles, the polymeric infrastructure of each of said particles comprising a polymer having a melting point greater than 80° C. and a number average molecular weight in the range of from about $5\times10^3$ up to about $1\times10^6$ selected from the group consisting of:

(a) at least one ethylene-vinyl acetate copolymer containing from about 10 up to about 90% vinyl acetate monomeric units;

(b) at least one blend of low density polyethylene and an ethylene-vinyl acetate copolymer, with the weight ratio of polyethylene:ethylene-vinyl acetate copolymer being from about 10:90 up to about 90:10 wherein the ethylene-vinyl acetate copolymer contains from about 10 up to 90% vinyl acetate monomeric units;

(c) at least one ester-terminated polyamide;

(d) a blend of at least one ester-terminated polyamide and at least one polysaccharide in a weight ratio range of from about 3:5 up to about 5:3; and (e) at least one $C_1$–$C_4$ alkyl methacrylate polymer;

wherein C $\log_{10}P$ is the calculated logarithm to the base 10 of the n-octanol/water partition coefficient for each of the fragrance components of said fragrance composition.

2. The process of claim 1 wherein the polymeric perfume composition-containing and evolving particle has an infrastructure composed of at least one blend of low density polyethylene and an ethylene-vinyl acetate copolymer, with the weight ratio of polyethylene:ethylene-vinyl acetate copolymer being from about 10:90 up to about 90:10 wherein the ethylene-vinyl acetate copolymer contains from about 10 up to 90% vinyl acetate monomeric units and is produced by extrusion.

3. The process of claim 2 wherein during the extrusion process step, a blowing agent is introduced, thereby causing the resultant particles to contain macropores, each of the free volumes of which contain a fragrance composition.

4. The process of claim 3 wherein the blowing agent is a mixture of beeswax, an alkali metal bicarbonate or carbonate and citric acid with a range of weight ratios of beeswax: alkali metal bicarbonate or carbonate:citric acid of from about 10:65:25 up to about 10:25:65.

5. The process of claim 1 wherein the polymeric perfume composition-containing and evolving particle has an infrastructure composed of at least one ester-terminated polyamide.

6. The process of claim 5 wherein the ester-terminated polyamide has a number average molecular weight in the range of from about of 5,000 up to about 8000.

7. The process of claim 6 wherein the ester-terminated polyamide has a number average molecular weight of about 6000 and a softening point in the range of 88° C. up to 94° C. prepared by reacting "x" equivalents of $C_{36}$ dicarboxylic acid, "y" equivalents of ethylene diamine and "z" equivalents of an alcohol selected from the group consisting of cetyl alcohol and stearyl alcohol wherein $$0.9 \le \left(\frac{x}{y+z}\right) \le 1.1 \text{ and } 0.1 \le \left(\frac{z}{y+z}\right) \le 0.7.$$

8. The method of claim 1 wherein a substantive fragrance is imparted to fabrics in an automatic clothes dryer comprising tumbling said fabrics under heat at a temperature in the range of from about 40° C. up to about 100° C. in said dryer with at least one three-dimensional sachet article which evolves, during at least one drying cycle, an effective amount of a fragrance-imparting composition at an effective rate said three-dimensional sachet article comprising:

i. a non-rigid or substantially rigid hollow containment means consisting of a non-rigid or substantially rigid container wall which is a perforated or continuous, thin lamina separating an inner void from an outer environment totally surrounding said inner void; having a height of from about 4 up to about 10 cm. and a width of from about 1 up to about 10 cm and which is permeable to fragrance compositions and anti-static property-imparting compositions, each of the fragrance components of which fragrance compositions has a calculated C $\log_{10}P$ of from about 1 up to about 8; and ii. contained within a major proportion of said inner void and supported by said non-rigid or substantially rigid perforated or continuous container wall, a plurality of polymeric fragrance composition-containing and evolving solid or visco-elastic particles which have a total weight of from about 2 grams up to about 50 grams, each of which has an average effective diameter of from about 0.5 mm up to about 10 mm, said fragrance composition being absorbed in the polymeric infrastructure of each of said polymeric particles, each of the components of said fragrance composition (A) being compatible with the polymer composing each of said polymeric infrastructures, (B) having a calculated C $\log_{10}P$ of from about 1 up to about 8 and (C) having a boiling point at atmospheric pressure of greater than about 150° C., said fragrance composition being from about 5% up to about 45% by weight of said particles, the polymeric infrastructure of each of said particles comprising a polymer having a melting point greater than 80° C. and a number average molecular weight in the range of from about $5\times10^3$ up to about $1\times10^6$ selected from the group consisting of:

(a) at least one ethylene-vinyl acetate copolymer containing from about 10 up to about 90% vinyl acetate monomeric units;

(b) at least one blend of low density polyethylene and an ethylene-vinyl acetate copolymer, with the weight ratio of polyethylene:ethylene-vinyl acetate copolymer being from about 10:90 up to about 90:10 wherein the ethylene-vinyl acetate copolymer contains from about 10 up to 90% vinyl acetate monomeric units;

(c) at least one ester-terminated polyamide;

(d) a blend of at least one ester-terminated polyamide and at least one polysaccharide in a weight ratio range of from about 3:5 up to about 5:3; and (e) at least one $C_1$–$C_4$ alkyl methacrylate polymer;

wherein C $\log_{10}P$ is the calculated logarithm to the base 10 of the n-octanol/water partition coefficient for each of the fragrance components of said fragrance composition.

9. The process of claim 8 wherein the % weight loss of fragrance Y vs. number of drying cycles, X is in accordance with the model:

$$Y=A \log_e X+B$$

wherein A is in the range of from about 2.5 up to about 10.5 and B is in the range of from about 1.5 up to about 31.5.

10. The process of claim 8 wherein the % weight loss of fragrance Y vs. the days of dryer operation, θ is in accordance with the model:

$$Y=-\alpha e^{-\beta\theta}+\gamma$$

wherein α is in the range of from about 3.0 up to about 4.5; β is in the range of from about 0.030 up to about 0.045 and γ is in the range of from about 2.5 up to about 5.5.

11. The method of claim 1 wherein substantive fragrance and long-lasting anti-static properties are imparted to fabrics in a washing machine and/or in an automatic clothes dryer comprising the step of tumbling said fabrics under heat at a temperature in the range of from about 40° C. up to about 100° C. in said washing machine and/or in said dryer with at least one three-dimensional sachet article which evolves, during the washing cycle and/or during at least one drying cycle, an effective amount of a fragrance-imparting composition at an effective rate and an effective amount of an anti-static property-imparting composition at an effective rate, said three-dimensional sachet article comprising:

i. a non-rigid or substantially rigid hollow containment means consisting of a nonrigid or substantially rigid container wall which is a perforated or continuous, thin lamina separating an inner void from an outer environment totally surrounding said inner void; having a height of from about 4 up to about 10 cm. and a width of from about 1 up to about 10 cm and which is permeable to fragrance compositions and anti-static property-imparting compositions, wherein each of the fragrance components of which fragrance compositions has a calculated C $\log_{10}$P of from about 1 up to about 8; and ii. contained within a major proportion of said inner void and supported by said non-rigid or substantially rigid perforated or continuous container wall, a plurality of polymeric fragrance composition and anti-static property-imparting composition-containing and evolving solid or visco-elastic particles which have a total weight of from about 2 grams up to about 50 grams, each of which has an average effective diameter of from about 0.5 mm up to about 10 mm, said fragrance composition, and said anti-static property-imparting composition each being absorbed in the polymeric infrastructure of each of said polymeric particles, each of the components of said fragrance composition (A) being compatible with the polymer composing each of said polymeric infrastructures, (B) having a calculated C $\log_{10}$P of from about 1 up to about 8 and (C) having a boiling point at atmospheric pressure of greater than about 150° C., said fragrance composition being from about 5% up to about 45% by weight of said particles, the polymeric infrastructure of each of said particles comprising a polymer having a melting point greater than 80° C. and a number average molecular weight in the range of from about $5\times10^3$ up to about $1\times10^6$ selected from the group consisting of:

(a) at least one ethylene-vinyl acetate copolymer containing from about 10 up to about 90% vinyl acetate monomeric units;

(b) at least one blend of low density polyethylene and an ethylene-vinyl acetate copolymer, with the weight ratio of polyethylene:ethylene-vinyl acetate copolymer being from about 10:90 up to about 90:10 wherein the ethylene-vinyl acetate copolymer contains from about 10 up to 90% vinyl acetate monomeric units;

(c) at least one ester-terminated polyamide;

(d) a blend of at least one ester-terminated polyamide and at least one polysaccharide in a weight ratio range of from about 3:5 up to about 5:3; and (e) at least one $C_1$–$C_4$ alkyl methacrylate polymer;

wherein C $\log_{10}$P is the calculated logarithm to the base 10 of the n-octanol/water partition coefficient for each of the fragrance components of said fragrance composition.

12. The method of claim 1 wherein substantive fragrance and long-lasting anti-static properties are imparted to fabrics in a washing machine and/or in an automatic clothes dryer comprising the step of tumbling said fabrics under heat at a temperature in the range of from about 40° C. up to about 100° C. in said washing machine and/or in said dryer with (a) at least one three-dimensional sachet article which evolves, during the washing cycle and/or during at least one drying cycle, an effective amount of a fragrance-imparting composition at an effective rate and (b) an effective amount of an anti-static property-imparting composition separate from said sachet article, said three-dimensional sachet article comprising:

i. a non-rigid or substantially rigid hollow containment means consisting of a non-rigid or substantially rigid container wall which is a perforated or continuous, thin lamina separating an inner void from an outer environment totally surrounding said inner void; having a height of from about 4 up to about 10 cm. and a width of from about 1 up to about 10 cm and which is permeable to fragrance compositions wherein each of the fragrance components of which fragrance compositions has a calculated C $\log_{10}$P of from about 1 up to about 8; and ii. contained within a major proportion of said inner void and supported by said non-rigid or substantially rigid perforated or continuous container wall, a plurality of polymeric fragrance composition-containing and evolving solid or visco-elastic particles which have a total weight of from about 2 grams up to about 50 grams, each of which has an average effective diameter of from about 0.5 mm up to about 10 mm, said fragrance composition being absorbed in the polymeric infrastructure of each of said polymeric particles, each of the components of said fragrance composition (A) being compatible with the polymer composing each of said polymeric infrastructures, (B) having a calculated C $\log_{10}$P of from about 1 up to about 8 and (C) having a boiling point at atmospheric pressure of greater than about 150° C., said fragrance composition being from about 5% up to about 45% by weight of said particles, the polymeric infrastructure of each of said particles comprising a polymer having a melting point greater than 80° C. and a number average molecular weight in the range of from about $5\times10^3$ up to about $1\times10^6$ selected from the group consisting of:

(a) at least one ethylene-vinyl acetate copolymer containing from about 10 up to about 90% vinyl acetate monomeric units;

(b) at least one blend of low density polyethylene and an ethylene-vinyl acetate copolymer, with the weight ratio of polyethylene:ethylene-vinyl acetate copolymer being from about 10:90 up to about 90:10 wherein the ethylene-vinyl acetate copolymer contains from about 10 up to 90% vinyl acetate monomeric units;

(c) at least one ester-terminated polyamide;

(d) a blend of at least one ester-terminated polyamide and at least one polysaccharide in a weight ratio range of from about 3:5 up to about 5:3; and (e) at least one $C_1$–$C_4$ alkyl methacrylate polymer;

wherein C $\log_{10}$P is the calculated logarithm to the base 10 of the n-octanol/water partition coefficient for each of the fragrance components of said fragrance composition.

13. The method of claim 1 wherein substantive fragrance and anti-static properties are imparted to fabrics in a washing machine and/or in an automatic clothes dryer comprising tumbling said fabrics under heat at a temperature in the range of from about 40° C. up to about 100° C. in said washing machine and/or in said dryer with at least one three-dimensional sachet article which evolves, during the washing cycle and/or during at least one drying cycle, an effective amount of a fragrance-imparting composition at an effective rate and an effective amount of an anti-static property-imparting composition at an effective rate said three-dimensional sachet article comprising:

i. a non-rigid or substantially rigid hollow containment means consisting of a non-rigid or substantially rigid container wall which is a perforated or continuous, thin lamina separating an inner void from an outer environment totally surrounding said inner void; having a height of from about 4 up to about 10 cm. and a width of from about 1 up to about 10 cm and which is permeable to fragrance compositions and anti-static property-imparting compositions wherein each of the fragrance components of which fragrance compositions has a calculated C $\log_{10}$P of from about 1 up to about 8, said container wall having absorbed therein and efficaciously removable therefrom at an effective rate, an effective amount of an anti-static property-imparting composition; and ii. contained within a major proportion of said inner void and supported by said non-rigid or substantially rigid perforated or continuous container wall, a plurality of polymeric fragrance composition-containing and evolving solid or visco-elastic particles which have a total weight of from about 2 grams up to about 50 grams, each of which has an average effective diameter of from about 0.5 mm up to about 10 mm, said fragrance composition being absorbed in the polymeric infrastructure of each of said polymeric particles, each of the components of said fragrance composition (A) being compatible with the polymer composing each of said polymeric infrastructures, (B) having a calculated C $\log_{10}$P of from about 1 up to about 8 and (C) having a boiling point at atmospheric pressure of greater than about 150° C., said fragrance composition being from about 5% up to about 45% by weight of said particles, the polymeric infrastructure of each of said particles comprising a polymer having a melting point greater than 80° C. and a number average molecular weight in the range of from about $5\times10^3$ up to about $1\times10^6$ selected from the group consisting of:

(a) at least one ethylene-vinyl acetate copolymer containing from about 10 up to about 90% vinyl acetate monomeric units;

(b) at least one blend of low density polyethylene and an ethylene-vinyl acetate copolymer, with the weight ratio of polyethylene:ethylene-vinyl acetate copolymer being from about 10:90 up to about 90:10 wherein the ethylene-vinyl acetate copolymer contains from about 10 up to 90% vinyl acetate monomeric units;

(c) at least one ester-terminated polyamide;

(d) a blend of at least one ester-terminated polyamide and at least one polysaccharide in a weight ratio range of from about 3:5 up to about 5:3; and (e) at least one $C_1$–$C_4$ alkyl methacrylate polymer;

wherein C $\log_{10}$P is the calculated logarithm to the base 10 of the n-octanol/water partition coefficient for each of the fragrance components of said fragrance composition.

14. The process of claim 1 wherein the average effective diameter of the polymeric fragrance particle is 1 mm.

15. A method for imparting a substantive fragrance and, optionally, anti-static properties to fabrics in a washing machine and/or in an automatic clothes dryer comprising tumbling said fabrics under heat at a temperature in the range of from about 40° C. up to about 100° C. in said washing machine and/or in said dryer with (a) at least one three-dimensional sachet article which evolves, during the washing cycle and/or during at least one drying cycle, an effective amount of a fragrance-imparting composition at an effective rate and, optionally, an effective amount of an anti-static property-imparting composition at an effective rate and, optionally, (b) an effective amount of an anti-static property-imparting composition separate from said sachet article, said three-dimensional sachet article comprising:

i. a non-rigid or substantially rigid hollow containment means consisting of a non-rigid or substantially rigid container wall which is a perforated or continuous, thin lamina separating an inner void from an outer environment totally surrounding said inner void; having a height of from about 4 up to about 10 cm. and a width of from about 1 up to about 10 cm and which is permeable to fragrance compositions and anti-static property-imparting compositions, each of the fragrance components of which fragrance compositions has a calculated C $\log_{10}$P of from about 1 up to about 8, said container wall optionally having absorbed therein and efficaciously removable therefrom at an effective rate, an effective amount of an anti-static property-imparting composition; and ii. contained within a major proportion of said inner void and supported by said nonrigid or substantially rigid perforated or continuous container wall, a plurality of polymeric fragrance composition and, optionally, anti-static property-imparting composition-containing and evolving solid or visco-elastic particles which have a total weight of from about 2 grams up to about 50 grams, each of which has an average effective diameter of from about 0.5 mm up to about 10 mm, and wherein the polymeric fragrance particle contains a fragrance release promoter, said fragrance composition, and said optional anti-static property-imparting composition each being absorbed in the polymeric infrastructure of each of said polymeric particles, each of the components of said fragrance composition (A) being compatible with the polymer composing each of said polymeric infrastructures, (B) having a calculated C $\log_{10}$P of from about 1 up to about 8 and (C) having a boiling point at atmospheric pressure of greater than about 150° C., said fragrance composition being from about 5% up to about 45% by weight of said particles, the polymeric infrastructure of each of said particles comprising a polymer having a melting point greater than 80° C. and a number average molecular weight in the range of from about $5\times10^3$ up to about $1\times10^6$ selected from the group consisting of:

(f) at least one ethylene-vinyl acetate copolymer containing from about 10 up to about 90% vinyl acetate monomeric units;

(g) at least one blend of low density polyethylene and an ethylene-vinyl acetate copolymer, with the weight ratio of polyethylene:ethylene-vinyl acetate copolymer being from about 10:90 up to about 90:10 wherein the ethylene-vinyl acetate copolymer contains from about 10 up to 90% vinyl acetate monomeric units;

(h) at least one ester-terminated polyamide;

(i) a blend of at least one ester-terminated polyamide and at least one polysaccharide in a weight ratio range of from about 3:5 up to about 5:3; and (j) at least one $C_1$–$C_4$ alkyl methacrylate polymer;

wherein C $\log_{10}$P is the calculated logarithm to the base 10 of the n-octanol/water partition coefficient for each of the fragrance components of said fragrance composition.

16. The process of claim 15 wherein the fragrance release promoter is paraffin wax.

17. The process of claim 16 wherein the polymeric fragrance particle contains in addition, calcium carbonate.

18. A method for imparting a substantive fragrance and, optionally, anti-static properties to fabrics in a washing machine and/or in an automatic clothes dryer comprising tumbling said fabrics under heat at a temperature in the range of from about 40° C. up to about 100° C. in said washing machine and/or in said dryer with (a) at least one three-dimensional sachet article which evolves, during the washing cycle and/or during at least one drying cycle, an effective amount of a fragrance-imparting composition at an effective rate and, optionally, an effective amount of an anti-static property-imparting composition at an effective rate and, optionally, (b) an effective amount of an anti-static property-imparting composition separate from said sachet article, said three-dimensional sachet article comprising:

i. a non-rigid or substantially rigid hollow containment means consisting of a non-rigid or substantially rigid container wall which is a perforated or continuous, thin lamina separating an inner void from an outer environment totally surrounding said inner void; having a height of from about 4 up to about 10 cm. and a width of from about 1 up to about 10 cm and which is permeable to fragrance compositions and anti-static property-imparting compositions, each of the fragrance components of which fragrance compositions has a calculated C $\log_{10}$P of from about 1 up to about 8, said container wall optionally having absorbed therein and efficaciously removable therefrom at an effective rate, an effective amount of an anti-static property-imparting composition; and ii. contained within a major proportion of said inner void and supported by said non-rigid or substantially rigid perforated or continuous container wall, a plurality of polymeric fragrance composition and, optionally, anti-static property-imparting composition-containing and evolving solid or visco-elastic particles which have a total weight of from about 2 grams up to about 50 grams, each of which has an average effective diameter of from about 0.5 mm up to about 10 mm, said fragrance composition, and a plasticizer selected from the group consisting of isopropyl myristate, diethyl phthalate, dibutyl phthalate, benzyl benzoate, mineral oil, a methyl ester of a vegetable-derived $C_{12}$–$C_{18}$ carboxylic acid and a glyceryl ester of a vegetable-derived $C_{10}$ carboxylic acid, and said optional anti-static property-imparting composition each being absorbed in the polymeric infrastructure of each of said polymeric particles, each of the components of said fragrance composition (A) being compatible with the polymer composing each of said polymeric infrastructures, (B) having a calculated C $\log_{10}$P of from about 1 up to about 8 and (C) having a boiling point at atmospheric pressure of greater than about 150° C., said fragrance composition being from about 5% up to about 45% by weight of said particles, the polymeric infrastructure of each of said particles comprising a polymer having a melting point greater than 80° C. and a number average molecular weight in the range of from about $5\times10^3$ up to about $1\times10^6$ selected from the group consisting of:

(a) at least one ethylene-vinyl acetate copolymer containing from about 10 up to about 90% vinyl acetate monomeric units;

(b) at least one blend of low density polyethylene and an ethylene-vinyl acetate copolymer, with the weight ratio of polyethylene:ethylene-vinyl acetate copolymer being from about 10:90 up to about 90:10 wherein the ethylene-vinyl acetate copolymer contains from about 10 up to 90% vinyl acetate monomeric units;

(c) at least one ester-terminated polyamide;

(d) a blend of at least one ester-terminated polyamide and at least one polysaccharide in a weight ratio range of from about 3:5 up to about 5:3; and (e) at least one $C_1$–$C_4$ alkyl methacrylate polymer;

wherein C $\log_{10}$P is the calculated logarithm to the base 10 of the n-octanol/water partition coefficient for each of the fragrance components of said fragrance composition.

* * * * *